US007344323B2

(12) United States Patent
Fries et al.

(10) Patent No.: US 7,344,323 B2
(45) Date of Patent: Mar. 18, 2008

(54) PORTABLE PRINTING SYSTEM

(75) Inventors: Todd Fries, Waukesha, WI (US); Edward P. Dyer, Germantown, WI (US); Donald V. Lyskawa, Grafton, WI (US)

(73) Assignee: HellermannTyton Corporation, Milwaukee, WI (US)

( * ) Notice: Subject to any disclaimer, the term of this patent is extended or adjusted under 35 U.S.C. 154(b) by 61 days.

(21) Appl. No.: 11/372,631

(22) Filed: Mar. 10, 2006

(65) Prior Publication Data

US 2006/0153618 A1 Jul. 13, 2006

Related U.S. Application Data

(62) Division of application No. 10/860,912, filed on Jun. 4, 2004, now Pat. No. 7,040,822.

(60) Provisional application No. 60/475,659, filed on Jun. 4, 2003.

(51) Int. Cl.
*B41J 3/36* (2006.01)

(52) U.S. Cl. ..... 400/88; 400/615.2; 400/611

(58) Field of Classification Search ..... 400/88, 400/615.2, 611

See application file for complete search history.

(56) References Cited

U.S. PATENT DOCUMENTS

| | | | | |
|---|---|---|---|---|
| 4,407,692 | A | | 10/1983 | Torbeck |
| 4,490,206 | A | | 12/1984 | Makley |
| 4,706,095 | A | | 11/1987 | Ono et al. |
| 4,807,177 | A | | 2/1989 | Ward |
| 5,078,523 | A | | 1/1992 | McGourty et al. |
| 5,222,818 | A | * | 6/1993 | Akiyama et al. ..... 400/61 |
| 5,267,800 | A | | 12/1993 | Petteruti et al. |
| D349,920 | S | | 8/1994 | Wendt et al. |
| 5,392,704 | A | * | 2/1995 | Silverberg et al. ..... 101/92 |
| D368,111 | S | | 3/1996 | Komatsu et al. |

(Continued)

FOREIGN PATENT DOCUMENTS

| | | |
|---|---|---|
| GB | 2066118 | 10/1997 |

(Continued)

OTHER PUBLICATIONS

Lab Safety Supply, Spring/Summer 2003 catalog, cover with pp. 315, 316, and 317.

(Continued)

*Primary Examiner*—Minh Chau
(74) *Attorney, Agent, or Firm*—Ryan Kromholz & Manion, S.C.

(57) ABSTRACT

A portable label printing system for printing on a variety of materials is disclosed. A retractable platen roller cooperates with a self-aligning print head in three planes cooperates for proper label printing registration. A display screen allows the user to view precisely what the actual label and associated indicia will look like when printed on a selected label. In addition, the printing system includes an optical sensor positioned to sense data marks on the backside of a label, located on a label supply roll, allowing the printing system to identify the label specifications and make necessary adjustments to affect print quality. Reverse feed of the label supply roll is possible. The label printing system further comprises a communication port for cooperation with various devices, such as online databases and computers.

15 Claims, 18 Drawing Sheets

U.S. PATENT DOCUMENTS

| | | | | |
|---|---|---|---|---|
| D389,859 | S | 1/1998 | Thuma et al. | |
| 5,741,079 | A | 4/1998 | Hayama et al. | |
| 5,760,799 | A | 6/1998 | Inui et al. | |
| D408,439 | S | 4/1999 | Sirois et al. | |
| D409,230 | S | 5/1999 | Gilbertson et al. | |
| 5,918,989 | A | 7/1999 | Stout, Jr. et al. | |
| D414,172 | S | 9/1999 | Hetfield et al. | |
| 5,951,177 | A | 9/1999 | Schanke et al. | |
| D414,760 | S | 10/1999 | Hetfield et al. | |
| 5,980,133 | A | 11/1999 | Nunokawa et al. | |
| 6,113,293 | A | 9/2000 | Schanke et al. | |
| 6,120,196 | A | 9/2000 | Matsuda | |
| 6,126,343 | A | 10/2000 | Sugiyama et al. | |
| 6,142,686 | A * | 11/2000 | Schanke et al. | 400/234 |
| 6,431,771 | B2 | 8/2002 | Nagai et al. | |
| 6,435,744 | B1 * | 8/2002 | Dunn et al. | 400/621 |
| D462,357 | S | 9/2002 | Jenkins | |
| 6,503,005 | B1 * | 1/2003 | Cockerill et al. | 400/88 |
| D473,261 | S | 4/2003 | Ohtani et al. | |
| 6,644,876 | B2 | 11/2003 | Carriere et al. | |
| 6,872,018 | B2 | 3/2005 | Jung | |
| D526,004 | S | 8/2006 | Obenshain et al. | |
| 2005/0068403 | A1 | 3/2005 | Okuchi et al. | |
| 2005/0151770 | A1 | 7/2005 | Takeuchi | |
| 2006/0032386 | A1 * | 2/2006 | Goodwin et al. | 101/250 |

FOREIGN PATENT DOCUMENTS

| | | |
|---|---|---|
| GB | 2071649 | 12/1998 |

OTHER PUBLICATIONS

Brady, Web Page—dated May 16, 2003—11 pages.
Panduit, Web Page—dated May 16, 2003—13 pages.

* cited by examiner

PORTABLE PRINTING SYSTEM

RELATED APPLICATION

This application is a divisional of U.S. patent application Ser. No. 10/860,912, filed 4 Jun. 2004, now U.S. Pat. No. 7,040,822 which claims the benefit of Provisional U.S. Patent Application Ser. No. 60/475,659, filed 4 Jun. 2003.

BACKGROUND OF THE INVENTION

1. Field of the Invention

This invention relates to the art of hand-held printing systems and more particularly to a portable thermal label printing system that has improved functionality for ease of operation and print quality.

2. Brief Description of the Prior Art

There has been previously disclosed a number of hand-held printers and various stationary printers with the ability to print indicia on labels. Examples of such hand-held label printers have been disclosed in U.S. Pat. Nos. 4,807,177, Ward; 5,918,989, Stout, Jr. et al.; 5,951,177, Schanke et al.; and 6,113,293, Schanke et al. The electronic apparatus of the types disclosed above commonly include a general combination of elements including a print head, means for feeding a labeling media to be printed past the print head, a microprocessor, a read only memory programmed with appropriate instructions to operate the microprocessor, a random access memory, a keyboard with letter, number, and function keys for the entry of alphanumeric information and instructions concerning the indicia to be printed, a battery for portable power, and a visual display such as an LED or LCD display to assist the operator in using the apparatus. In a hand held printer, these components may all be enclosed in a single housing.

Prior art hand-held label printers require a user to manually input data pertaining to the label type to be printed. Although this provides the printer with the appropriate specifications to properly print the label, it also introduces the possibility of user error. Other prior art printers have incorporated the use of electronic components within the label support spindle to thereby identify the label specifications. This approach has reduced user error, but it has also increased the cost of manufacture, and increased the number of electronic components that could possibly fail.

In a thermal transfer printer such as a label printer, both the label supply roll and the ink ribbon pass together in overlay relationship between the print head and the platen roller. Typically, the print head and the platen roller are in fixed positions relative to each other. Printers of this type require the user to remove the ink ribbon and then delicately feed the label supply roll between the print head and the platen roller and within the printer for proper alignment and printing. This adds to the time and complexity of installing the label supply roll within the printer, and is compounded when a variety of label types are used.

Yet another deficiency in the art of hand held label printers is the ability to view an accurate representation of a designed label before the label is actually printed. As noted above, previous printers commonly incorporate a visual display such as an LED or LCD display to assist the operator in using the apparatus. The display allows visual confirmation of the indicia being applied to a label, but not a visual confirmation of the indicia being applied to a label relative to the label itself. This deficiency in the art creates wasted labels, as a user is required to print a sample label to confirm a proper label layout.

Also, many of these previously disclosed thermal printers have attempted to solve the problem of waste due to advancing the label supply roll and the ink ribbon by including a reverse feed function to enable recapture of these wasted portions. However, reversing the ribbon feed direction can introduce ribbon wrinkling and telescoping, which leads to misprinted labels and frustrated users.

Furthermore, prior art hand-held printers have had limited download capabilities. Previous printers have incorporated expensive interfaces to allow for data downloading or software upgrades, while other printers have had limited capabilities to communicate with a computer or an online database. These restrictions have limited the ability of hand held printers to remain current with the latest in label options, graphic images, user languages, and software.

Because of the foregoing deficiencies in the art, an object of the present invention is to provide a compact portable printing system that solves these problems by making the device easier to operate and simplifies the label design and printing process.

SUMMARY OF THE INVENTION

The present invention comprises a method and apparatus for printing labels and the like. Specifically, the present invention provides a novel handheld, easily transportable device that is capable of printing on supplied labels. Labels to be used with the present invention may be manufactured from a variety of materials, including, but not limited to paper, white and metalized polyester, vinyl, film, cloth, and tamper evident material, such as tamper evident vinyl. Additionally, labels to be used with the present invention may be of varying dimension and, if carried on a removable backing material, may be spaced relative to each other within a varying parameter. Labels having the various qualities mentioned also present varying printing requirements. Printing requirements of this type include variation in print head heat and label speed past a print head. By way of non-limiting example, labels made from vinyl require a lower print head heat than those made from polyester. As so to maintain superior print quality, the dwell time at the print head of the vinyl label is longer than the dwell time for the polyester label.

The apparatus of the present invention is uniquely adapted to receive the mentioned variety of label materials, detect particular incoming label material characteristics, adapt the printing head and label speed to those particular characteristics, and print on the label. Further, if labels to be printed according to the present invention are carried on a removable backing strip, the apparatus is adapted to detect label spacing and adapt print placement accordingly.

One novel feature of the apparatus according to the present invention includes a unique retractable platen roller arrangement that allows rolled labels to be easily changed without necessitating time consuming threading over spindles. The retractable platen roller arrangement includes a cover latching system and label guide bracket to assure proper registration of the platen roller with the print head.

Another novel feature of the present invention includes a unique, self-aligning print head. The novel print head includes means for self-alignment in three planes. This feature allows the print head to maintain a uniform pressure against a passing label and ink ribbon, and further cooperate with the retractable platen roller during printing.

There is also provided a unique chassis design that allows ink ribbon, such as thermal transfer ribbon, to be changed with minimal movement of apparatus parts to do so. The ribbon is preferably disposed within a ribbon cartridge housing having a configuration conforming to a complementarily shaped cavity in the chassis. The ribbon cartridge housing also preferably includes a ribbon supply spool and a ribbon take-up spool thereby organizing the ribbon cartridge in a compact unit.

A further unique feature of the present invention is the relationship between the display screen and the actual label print. The present invention allows a user to view the text or graphics to be printed via a conventional display screen. The display represents the print as it will appear with reference to a label. The apparatus is adapted to transfer the display image to a label in a true manner, such that the display screen represents the placement and relative size of the print to be printed on a selected label. This feature allows the user to view the actual label print layout and spacing prior to printing on the label.

The printing apparatus according to the present invention is further uniquely adapted to efficiently operate in both a forward and reverse label feed direction, thereby reducing label waste. The labels to be printed are fed in the direction of the print head and, after printing, are moved to a label tear off point. Printed labels dwell in the apparatus temporarily as they advance toward the tear off point. If a user wishes to change the print text and further capture all printed labels dwelling in the apparatus, the user may advance the labels such that all printed labels are moved past the tear off point. The label feed direction is reversed such that non-printed labels that have advanced past the print head and toward the label tear off point may be recaptured for subsequent printing. The apparatus is uniquely adapted to reduce ink ribbon waste and telescoping during reverse operation.

The apparatus is further adapted to cooperate with various input devices, such as online databases and computers.

The invention provides a convenient to use, compact arrangement for a hand held label printer.

DESCRIPTION OF THE PREFERRED EMBODIMENT

Figure 1:
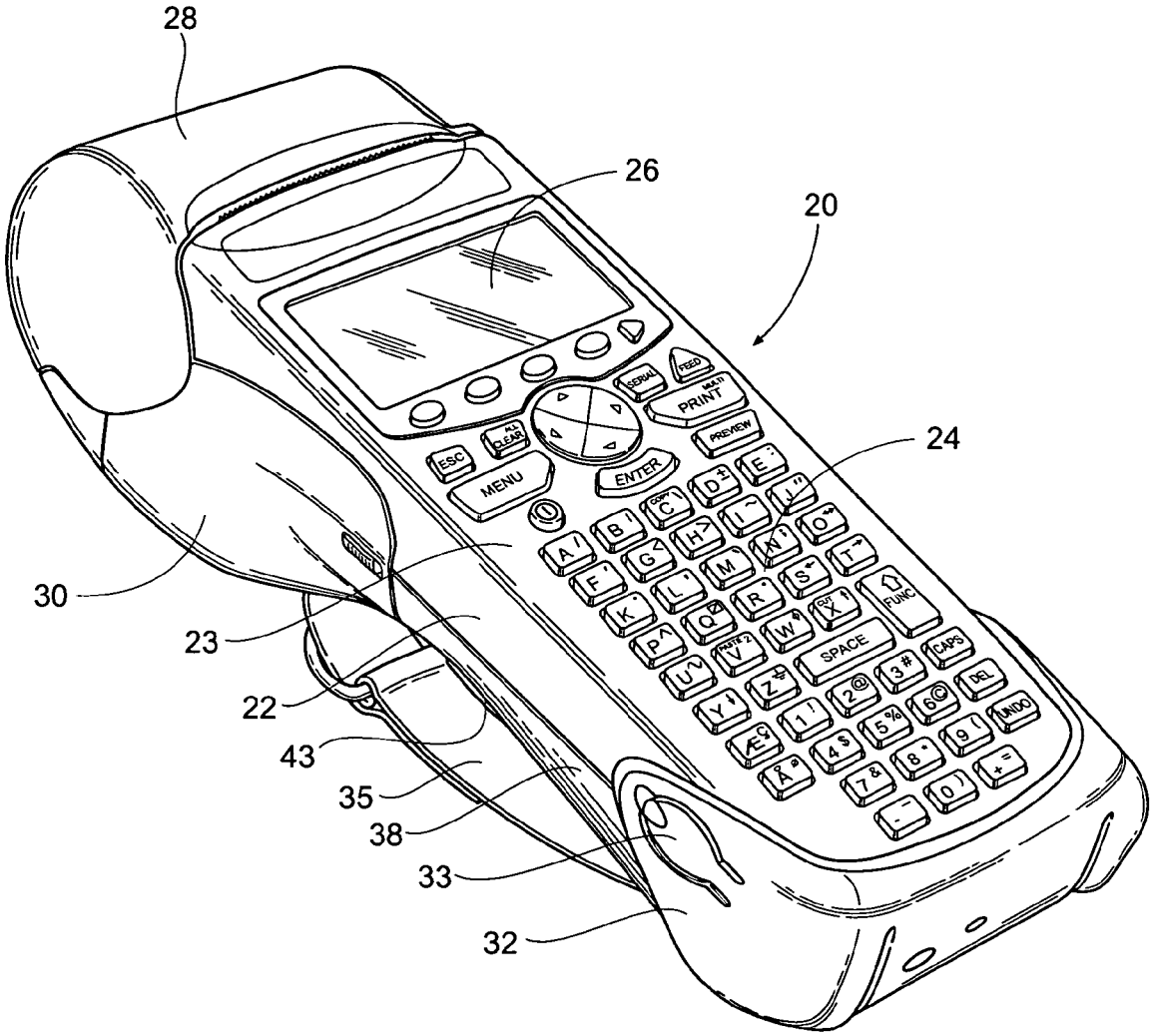
FIG. 1 is a perspective view of a hand held portable printing system which embodies the present invention.

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Referring to the drawings, wherein like numerals represent like parts throughout the views, there is generally designated at 20 an ergonomically designed, hand held portable printing system according to the present invention. As seen particularly in FIGS. 1 and 2, the printing system 20 includes an upper housing 22 and a lower housing 38.

The upper housing 22 supports a keyboard 24 on its front face and a graphic display 26 laterally spaced from the keyboard 24. The unique alphanumeric keyboard 24 is preferably composed of an integrally formed, continuous elastomer membrane. This configuration prevents a control circuit board 48 (FIG. 12) located below the keyboard 24 from getting damp or wet due to weather or spills. The keyboard 24 preferably extends the full length and width of the control circuit board 48 to provide maximum protection of the board 48.

Figure 12:
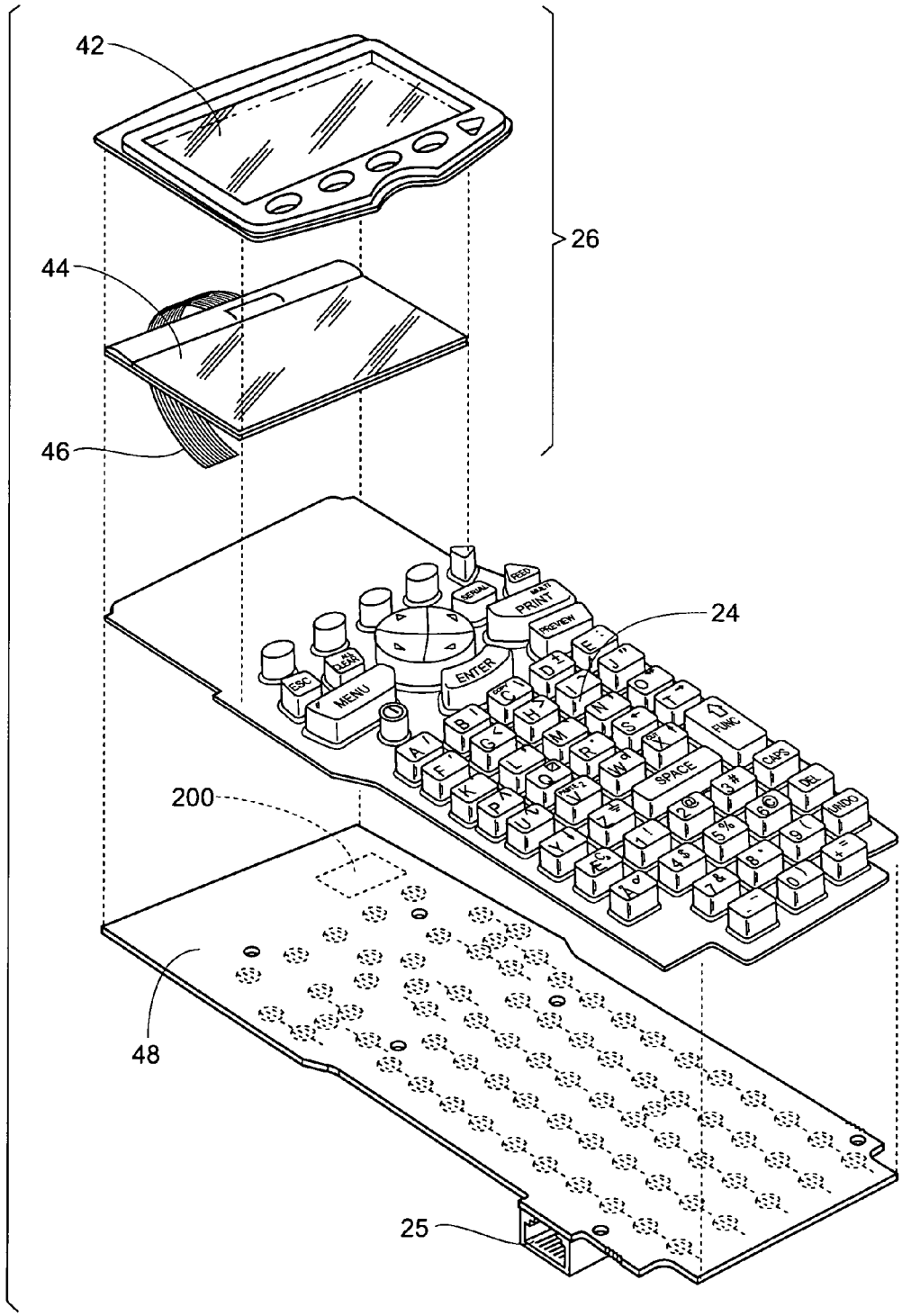
FIG. 12 is an exploded perspective view of the keyboard and display seen in FIG. 1, and showing relation to the control circuit board.
Figure 13:
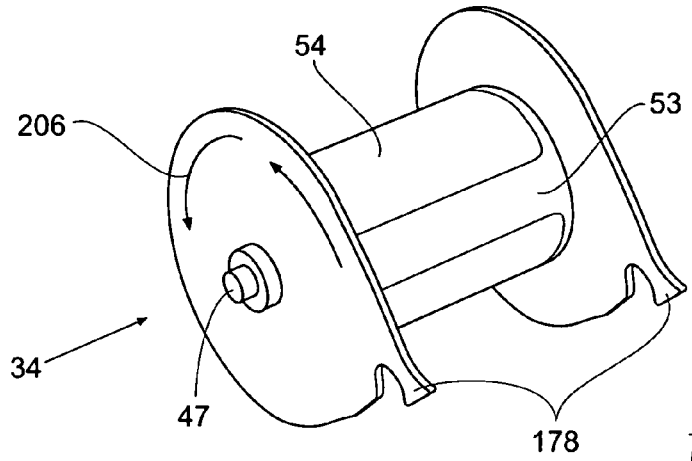
FIG. 13 is a perspective view of a reusable label spindle according to the present invention.

As best seen in FIG. 12, an ambient temperature sensor 200 located on the control circuit board 48 senses the ambient temperature and provides feedback to the control circuit board 48. Based on the ambient temperature feedback received, the control circuit board 48 will adjust power output to the graphic display 26 and the print head 94 (shown in FIG. 4) for optimal performance and operation.

The control circuit board 48 of FIG. 12 also includes a processor and memory (not shown). Preferably, a processor used in conjunction with the printing system 20 is at least an eight-bit reduced instruction set computer ("RISC") processor running at six megahertz, but any processor that will efficiently perform controls for the printing system is acceptable. The available memory on the control circuit board 48 preferably includes at least 128K of program storage, 128K of high-speed static RAM, and 256K bytes of flash non-volatile memory. The memory of the printing system 20 allows for the format of labels 54 (FIGS. 15 and 16) to be saved and retrieved for future use. The mentioned 256K bytes of flash non-volatile memory preferably contains label formatting information, language, graphic images and other information that can be downloaded to the printing system 20 via an RS-232 communication port 25, shown in FIG. 12.

The RS-232 communication port 25 enables the printing system 20 to download new label sizes, graphic images, and languages directly to the printing system 20 via a standard RJ45 phone jack from a standard computer (not shown). The communication port 25 can operate at any acceptable speed, preferably not greater than 19.2K baud. This new information can be downloaded off of an Internet site. Preferably, English is the default language, but other languages can be downloaded into the unit on demand at the discretion of the user.

Figure 2:
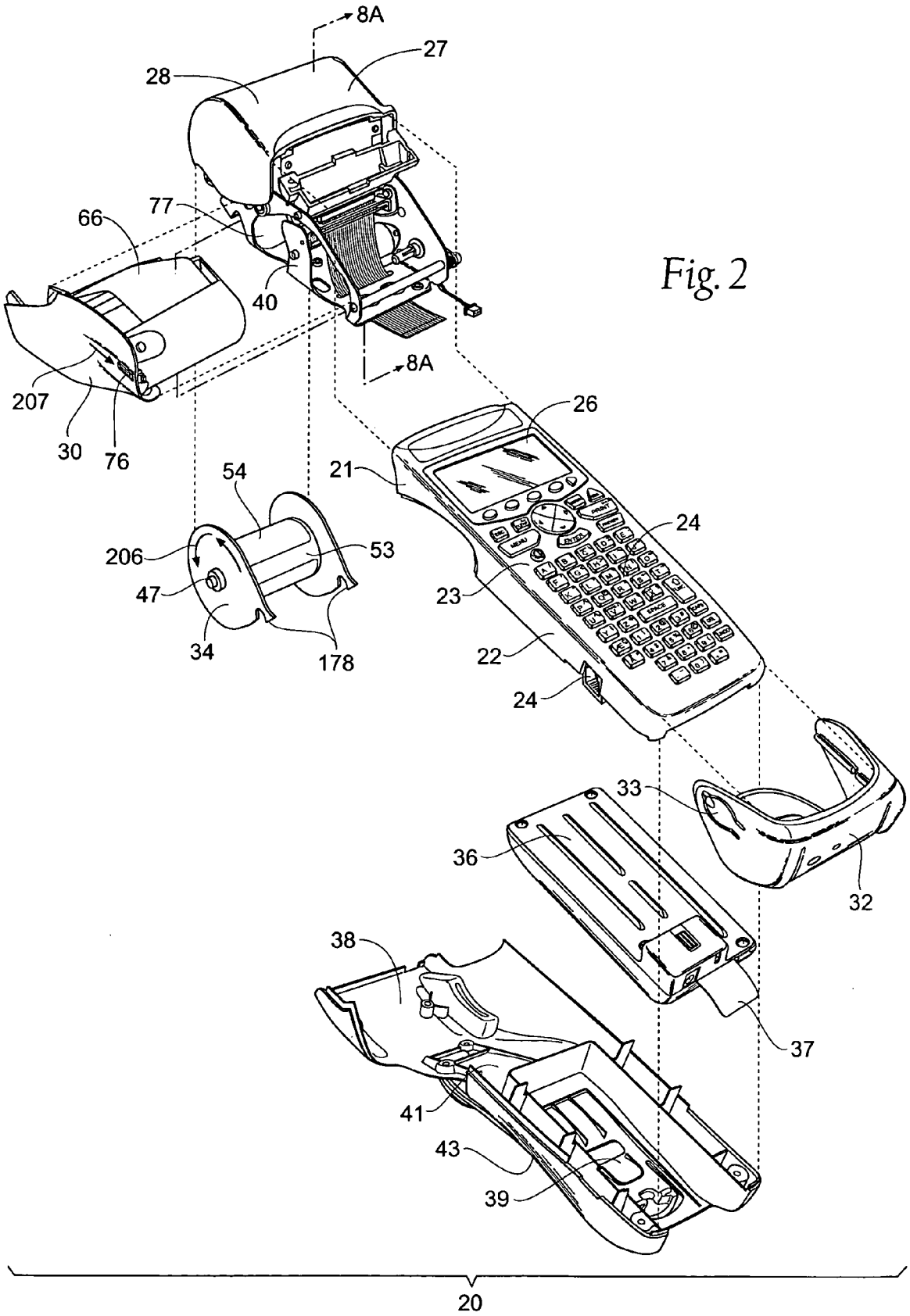
FIG. 2 is a partially exploded perspective view of the printing system shown in FIG. 1.

Referring to FIGS. 1 and 2, the lower housing 38 includes a first side 41 having a cavity 39 formed therein for receiving a rechargeable battery 36. An adjustable hand strap 35 may be attached to a bottom side 43 of the lower housing 38 for ease of handling. The ability of the printing system 20 to be powered by a rechargeable battery 36 makes the printing system 20 extremely portable and accessible. In a preferred embodiment, a NiCad battery 36 is utilized. The NiCad battery 36 preferably is adapted to use a standard adapter, such as a 120V, 230V, or 100V adapter (not shown), and may be fully charged within three to four hours. Removal of the rechargeable battery 36 in to and out of the printing system 20 allows for multiple batteries to be used. For example, as one battery is used in the printing system 20, another battery may be charged for future use. A shock absorbent boot 32 covers the battery cavity 39 and provides protection for the hand held printing system 20 during field use. The boot 32 also provides a cover 33 for the RS-232 communication port 25.

A novel feature of the present invention is the ability of the printing system 20 to print quality labels 54 (see FIGS. 15 and 16) until the battery 36 loses charge. Preferably, an algorithm is built within the control circuit that senses the charge of the battery 36 and causes the battery 36 to work harder to print as the power of the battery 36 degrades over time, which ensures that there is no change in print quality over the life of the battery 36. Only the last printed label would have degradation of quality. The printing system 20 has further been adapted to display the amount of battery life left on the graphic display 26.

Figure 15:
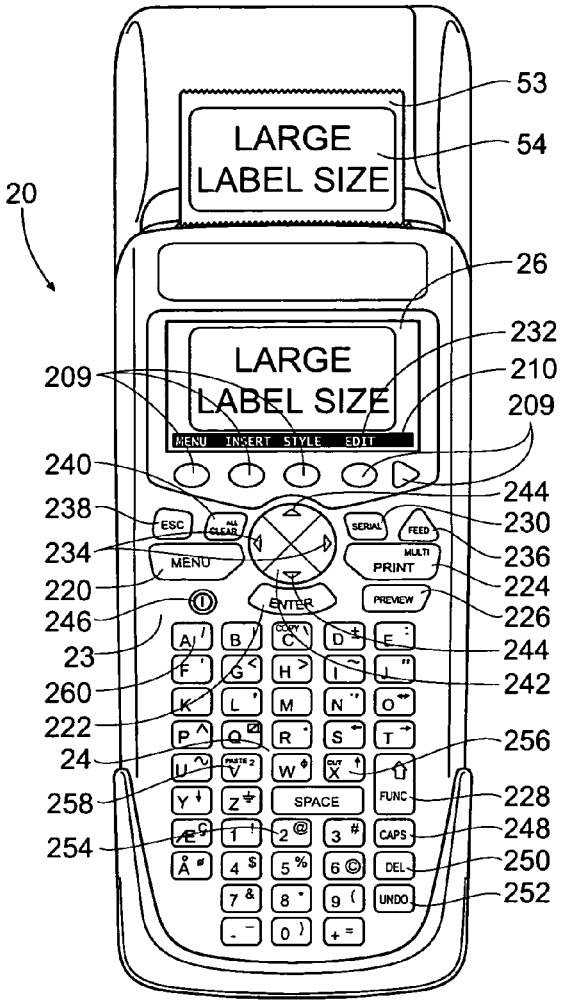
FIG. 15 is a top plan view of the printing system of FIG. 1, with a printed label ready for tear off and showing the relationship between what is viewed on the display and what is printed on a label.
Figure 16:
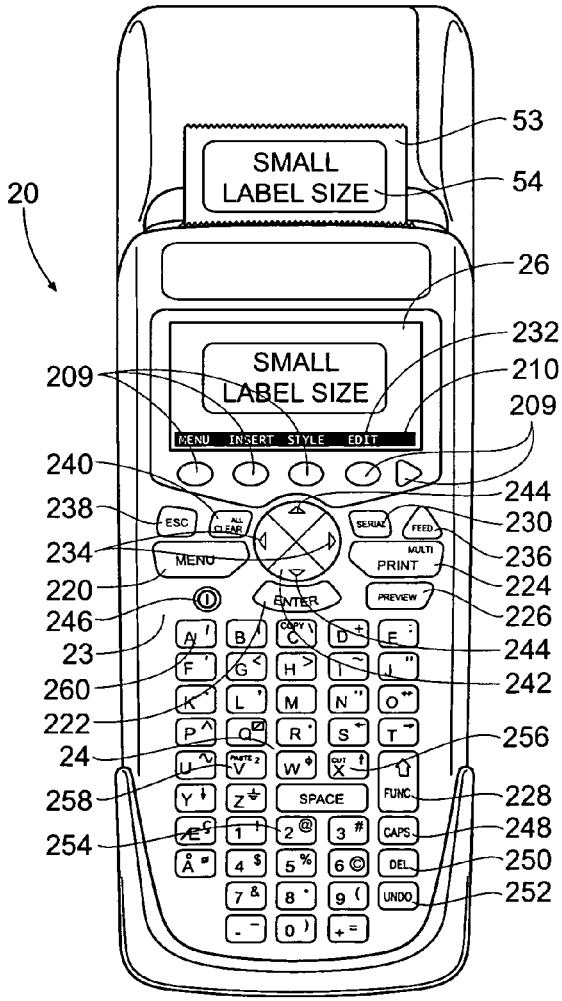
FIG. 16 is a top plan view of the printing system of FIG. 1, similar to that of FIG. 15, and showing the relationship between what is viewed on the display and what is printed on a label, with a relatively small label being visible.

As best seen in FIGS. 12, 15, and 16, the graphic display 26 is preferably comprised of a display lens 42 and a LCD display 44. The display 44 may be a 2.0"×1.5" viewable graphics LCD display, preferably containing 128×64 pixels. The LCD display 44 is capable of showing multiple font sizes, for example, small, medium, and large, with the sizes being relative to the size of the specific label 54 being selected and displayed. A virtual font feature allows the software to determine what is small, medium, and large. A maximum of 20 characters can be displayed and printed on a 1" (25.4 mm) or 2" (50.8 mm) wide label. In a preferred embodiment, the contrast of the LCD display 44 may be manually adjusted.

As viewed in FIGS. 15 and 16, a series of "Softkeys" 210 appear on the graphic display 26 and change depending on the currently selected editing mode. Pressing a corresponding button 209 activates the specific softkey function. The activated function appears directly above each button 209 the graphic display 26. This novel softkey feature eliminates the total number of keys on the keypad 24 and allows easy editing and minimization of help screens and menus.

With further reference to FIGS. 15 and 16, it may be seen that the label editing may be considered "WYSIWYG" (what you see is what you get). The software used in conjunction with the present invention is adapted to provide a virtual image of the label 54 on the graphic display 26, thereby allowing the display 26 to show the user what will print on a selected label 54. The currently edited line preferably shows a flashing cursor (not shown) below it.

As viewed in FIG. 2, the lower housing 38 further supports a print assembly 40. The print assembly 40 houses a reusable label spindle 34 and an ink ribbon cartridge 30. As seen particularly in FIG. 14, the reusable label spindle 34 includes a label supply roll 55 which may include a carrier web 53 with adhesively backed labels 54 attached thereto. A cover assembly 28 encloses the label spindle 34 and is pivotally mounted to the print assembly 40. The novel design of the pivotally mounted cover assembly 28 and the print assembly 40 allows loading and unloading of the reusable label spindle 34 and label supply roll 55 easier and quicker than in previous printers. The label supply roll 55 having labels 54 carried thereon is loaded onto the reusable spindle 34 (see FIG. 14). The spindle 34 is inserted into the printing system 20, and the label supply roll 55 is pulled over the top of the spindle 34, similar to the process of loading film into a camera, and the cover assembly 28 is closed. The design alleviates the time consuming requirement of mechanically feeding and aligning the label supply roll throughout the printing system 20.

Label Supply Roll

Figure 7:
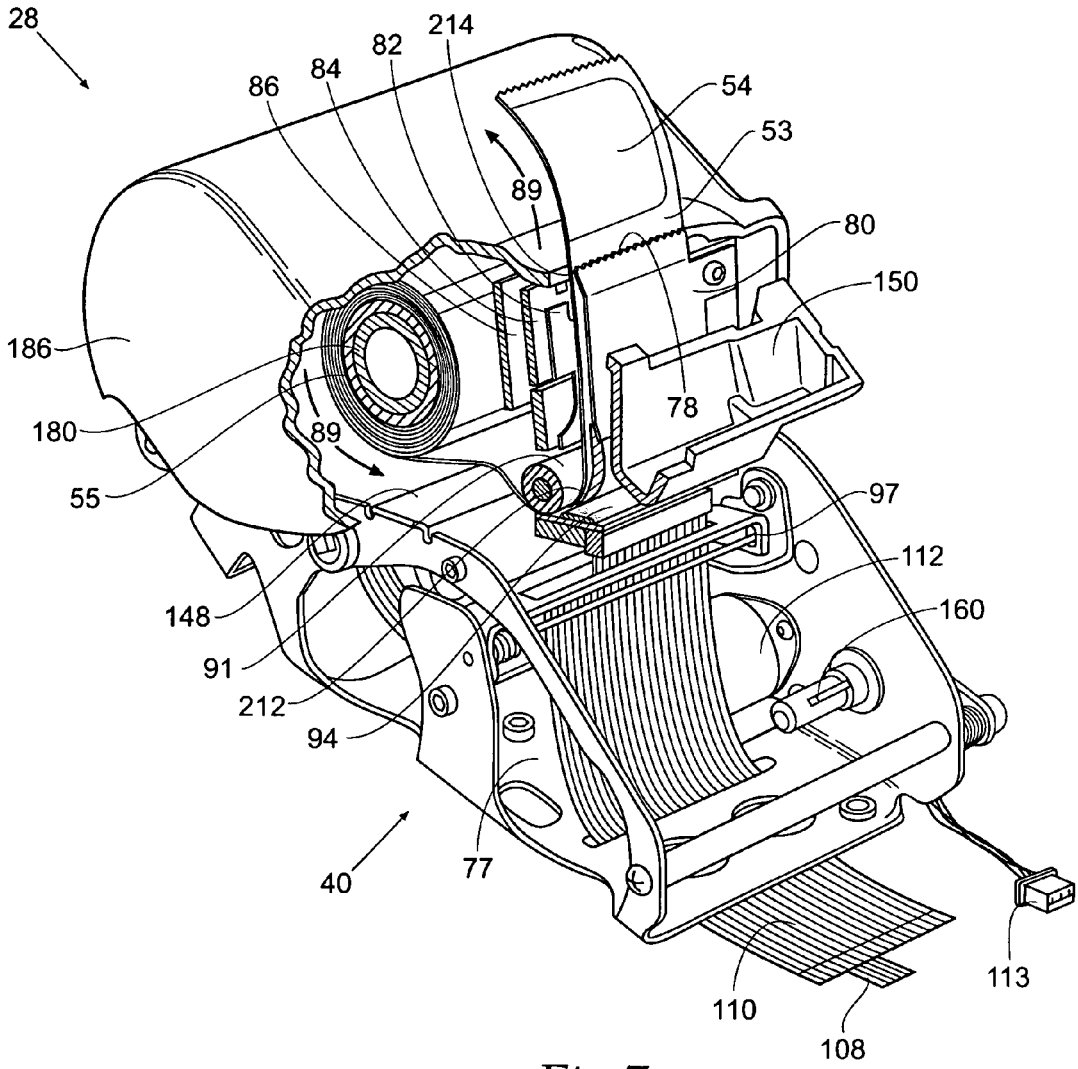
FIG. 7 is a partially cut-away perspective view of the cover and print assemblies of FIG. 2 in a closed, printing position, and showing the label supply spool path.
Figure 14:
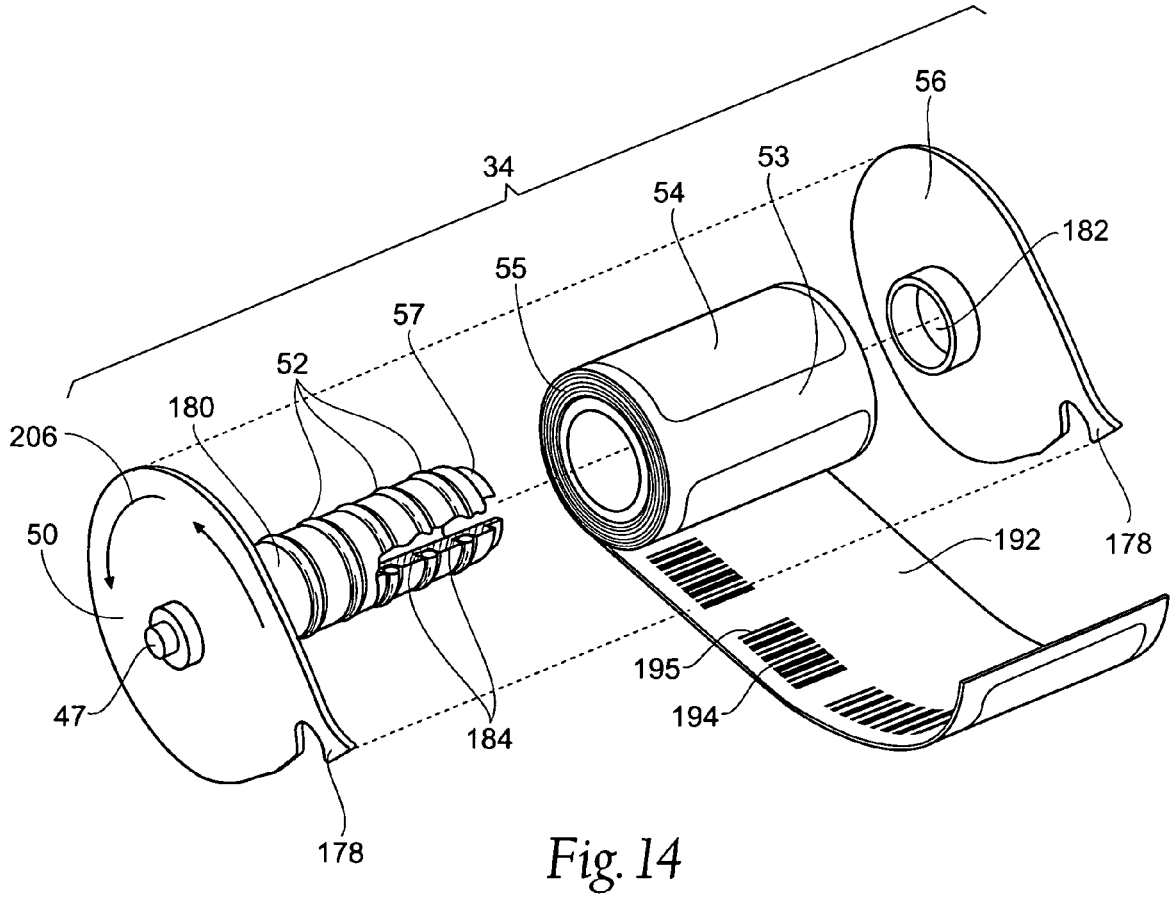
FIG. 14 is an exploded perspective view of the reusable label spindle of FIG. 13.

Referring now to FIGS. 7 and 14, the label supply roll 55 comprising the carrier web 53 carrying the adhesive labels 54 is shown. The size and type of the label material carried by the reusable label spindle 34 varies depending on the particular print application. Although adhesive labels 54 carried on the web 53 are shown, it is to be understood that the printing system 20 may also print on other material, such as, for example, shrink wrap (not shown). As the printing system 20 consumes the label supply roll 55, it unrolls off the label spindle 34 until the label spindle 34 is empty. The back side 192 of the carrier web 53 preferably includes data marks or other information that is optically readable, such as the barcode 194 shown in FIG. 14, for identification of label 54 specifications including type, size, print head heat, print speed, and label distance from one label to the next. The novel barcode 194 identification means eliminates the need for other more expensive means for label identification.

Figure 17:
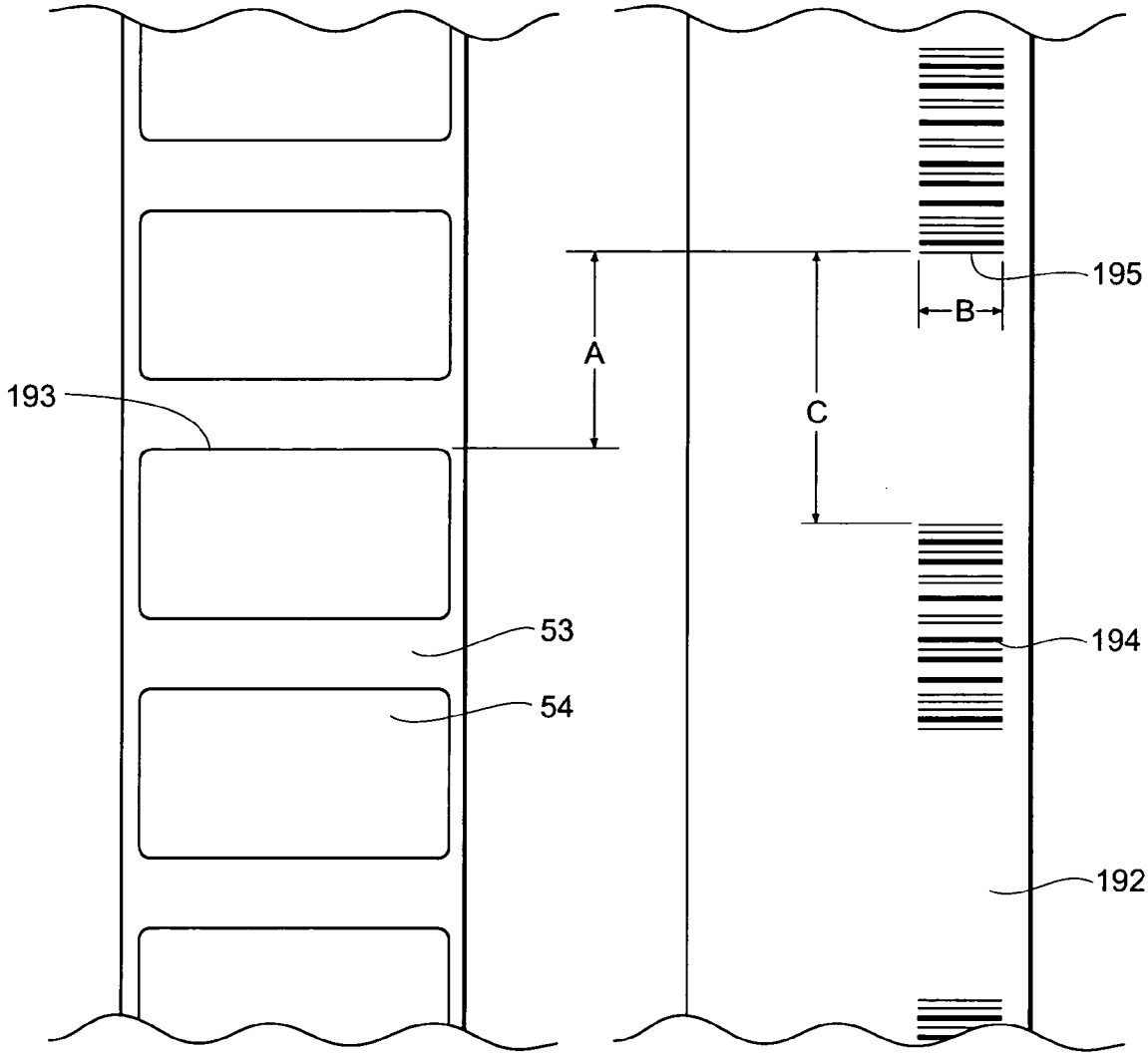
FIG. 17 is a fragmentary, top plan view of a carrier web with spaced-apart labels affixed thereto, with the reverse side depicted to thereby show the relationship between the data marks and the labels.

Referring now to FIG. 17, and by way of non-limiting examples, an edge 193 of the label 54 begins at a predetermined point A after the end 195 of the barcode 194. In a preferred embodiment, the edge 193 of the label 54 begins 1.12" after the end 195 of the barcode 194. In addition, the barcode 194 is of a predetermined width, B and repeats as often as possible, while maintaining a minimum predetermined distance C between barcodes 194. The width B would be 1.122" wide and the minimum distance C would be 0.20", although other suitable widths B and distances C may be used.

Ink Ribbon Cartridge

Figure 3:
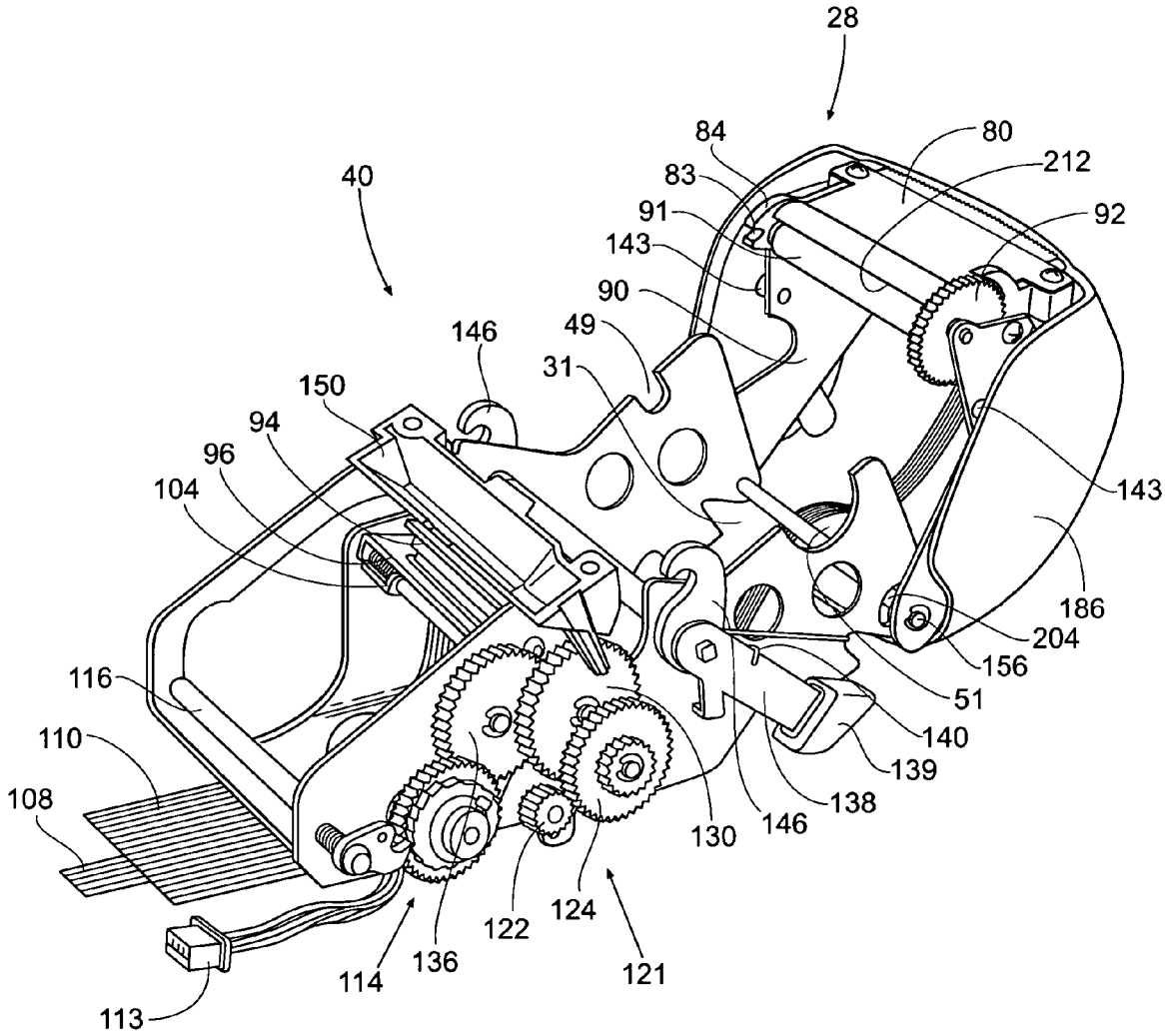
FIG. 3 is a perspective view of the cover and print assemblies of the printing system shown in FIGS. 1 and 2 in an open, label spindle-receiving position.
Figure 11:
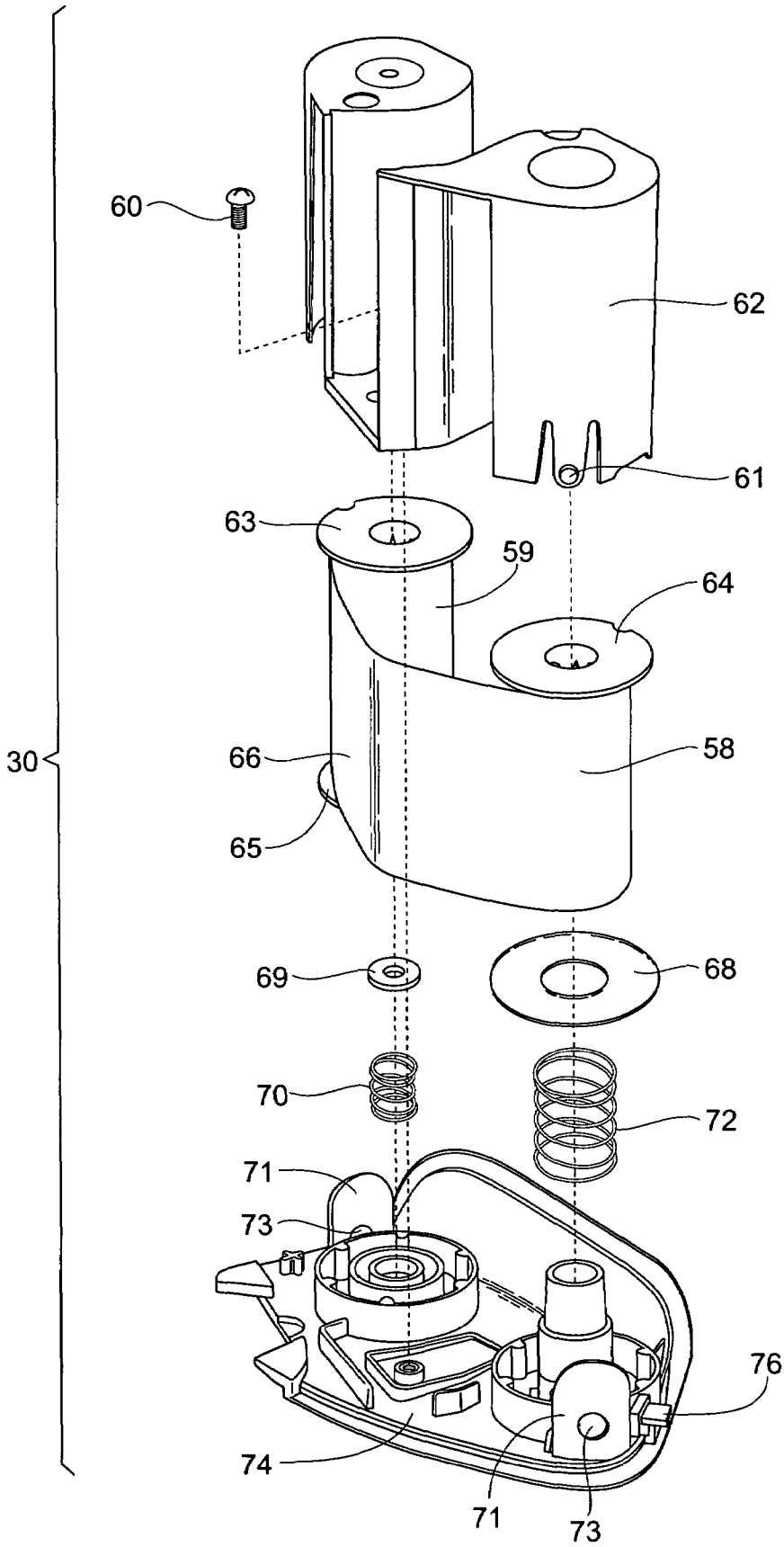
FIG. 11 is an exploded perspective view of an ink ribbon cartridge to be used with the present invention.

Referring now to FIGS. 2 and 11, an ink ribbon cartridge 30 having thermal transfer ribbon 66 disposed within a ribbon cartridge housing 62 is shown. The ink ribbon cartridge 30 is inserted into a cavity 77 in the side of the printing system 20 and is further received and supported by a drive cog 160 (FIG. 3). The drive cog 160 provides automatic radial alignment during insertion into the cavity 77. The ribbon cartridge housing 62 is attached to a ribbon cartridge door 74 by any conventional means, such as in this embodiment, a screw 60 and cartridge door tabs 71. Each tab 71 on the cartridge door 74 preferably includes an aperture 73. The ribbon cartridge housing 62 further includes a mating portion 61 that snaps into a corresponding aperture 73. The ribbon cartridge door 74 includes a door latch 76 for securing the ink ribbon cartridge 30 within the ribbon cartridge cavity 78. In a preferred embodiment, a supply spool 59 for thermal transfer printing onto the label 54, and a take-up spool 58 for taking up the ribbon 66 after being used in the thermal transfer printing process, are accommodated within the ribbon cartridge housing 62. The supply spool 59 is supported within the ribbon cartridge housing 62 by supply spool keys 63 and 65, which are inserted into the ends of the supply spool 59. A thrust washer 69 is inserted into the supply spool key 65, which in conjunction with a thrust spring 70 seated on the ribbon cartridge door 74, prevents telescoping of the ribbon 66 and provides positioning and proper tension during winding. Similarly, the take-up spool 58 is supported within the ribbon cartridge housing 62 by a take up spool key 64, which is inserted into a first end of the take-up spool 58. A door spring 72 seated on the ribbon cartridge door 74, in conjunction with spacer washer 68, located between the door spring 72 and the take-up spool 58, provides positioning and proper tension during winding for the take-up spool 58.

Figure 1A:
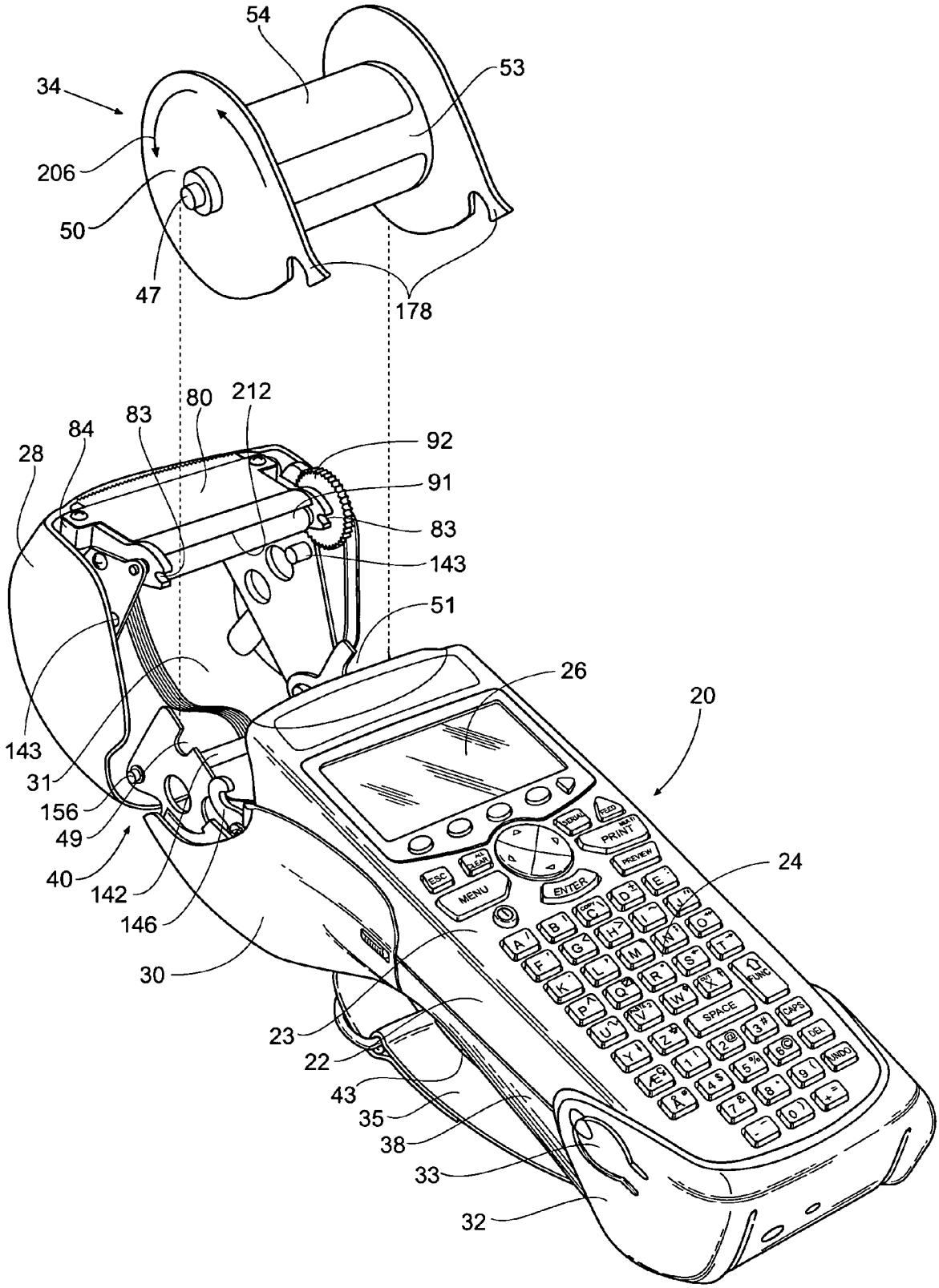
FIG. 1A is a perspective view of the printing system in FIG. 1 with the cover in an open, label spindle-receiving position.

As best seen in FIG. 1A, the design of the printing system 20 allows the ribbon cartridge 30 to remain in the printing system 20 while changing the label spindle 34. This feature saves time for the user and reduces the chance of damage to the printing system 20 or the ink ribbon cartridge 30, since the ribbon cartridge 30 does not have to be removed when during the spindle 34 changing process. Furthermore, the provided ribbon 66 (see FIG. 11) is preferably of a greater overall length than the current industry standard, which translates into fewer ribbon cartridge 30 changeovers, again reducing the chance for damage to the printing system 20.

Print Assembly

Figure 4:
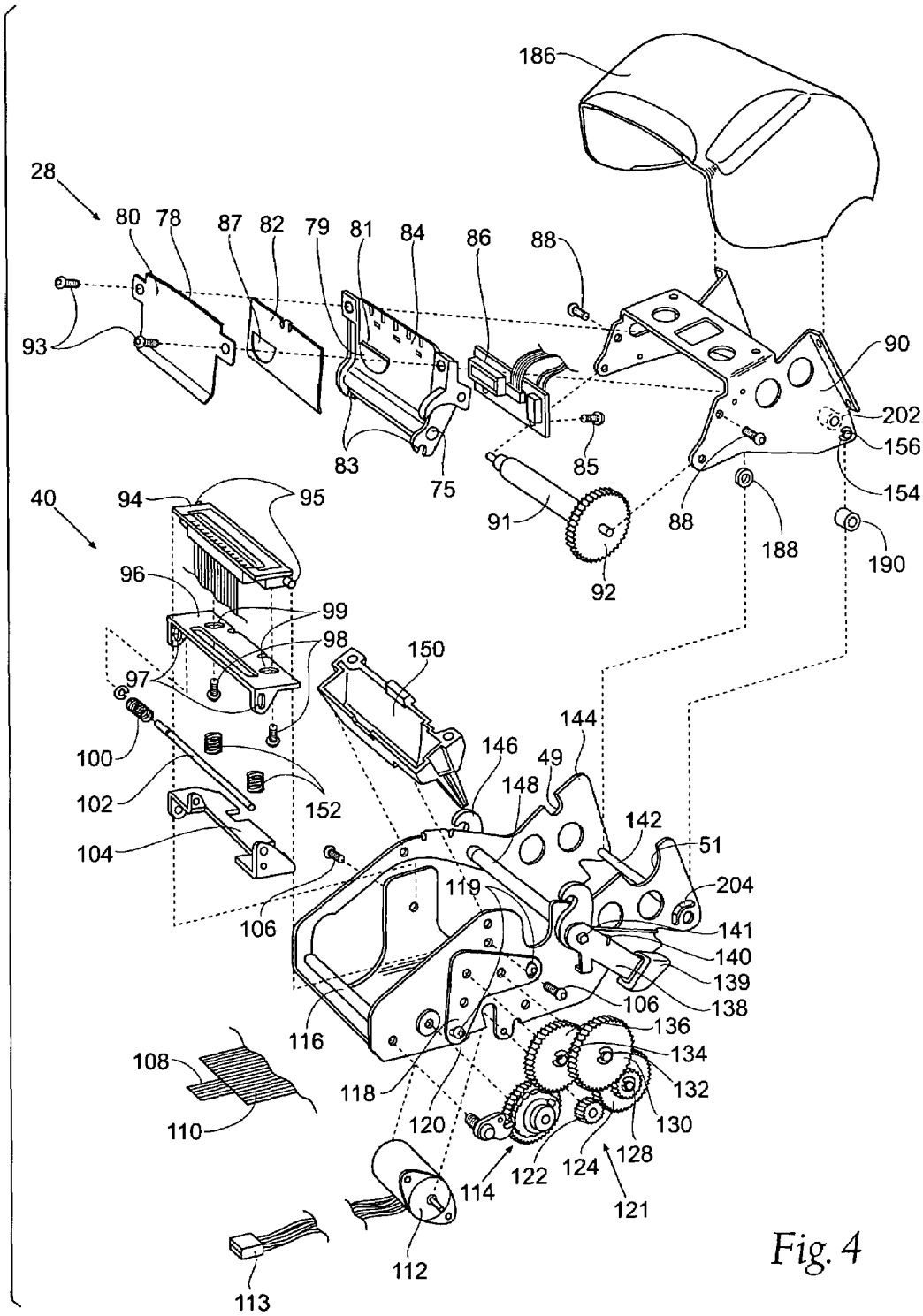
FIG. 4 is an exploded perspective view of the cover and print assemblies of FIG. 3.
Figure 8A:
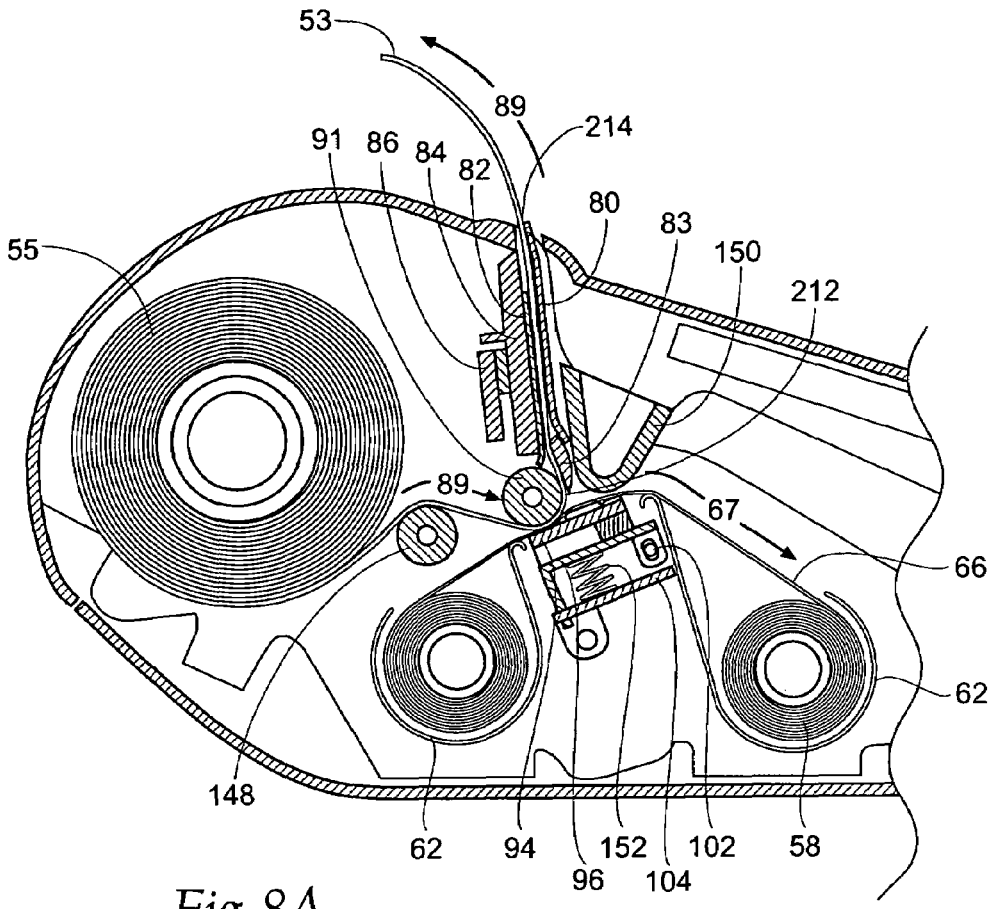
FIG. 8A is a fragmentary cross section view taken along line 8A-8A of the printing system in FIG. 2, showing the label supply roll and thermal transfer ribbon paths.

Referring now to FIGS. 4, 7, and 8, a print head 94 is disposed within the print assembly 40. In a preferred embodiment, the print head 94 is a 203 dpi thermal transfer print head, although other print heads 94 may be used. The print head 94 is positioned to cooperate with the thermal transfer ribbon 66 and the label supply roll 55 such that the print head 94 can print characters or symbols on the adhesive labels 54 as the label supply roll 55 moves along a preselected path within the print assembly 40.

More specifically, and as is best seen in FIG. 4, the print head 94 is mounted to a stabilizer bracket 96 by conventional means, such as the two screws 98 shown. The stabilizer bracket 96 preferably includes two slots 99 to allow for position adjustment of the print head 94. A tension bracket 104 mounted to a print head chassis 144 by way of two screws 106 provides support for the print head 94. Two print head support tension springs 152 are positioned between the stabilizer bracket 96 and the tension bracket 104 to provide for up and down or elevational alignment of the print head 94 with respect to the preselected path of the label supply roll 55. Slots 97 in the stabilizer bracket 96 provide for left and right alignment of the print head 94, or transverse alignment with respect to the preselected path of the label supply roll 55. The print bracket spindle 102, in conjunction with a print head alignment compression spring 100, provides the spatial relationship, including left and right alignment, between the tension bracket 104 and the stabilizer bracket 96. Print head alignment pins 95 coupled into label guide bracket yokes 83 provide for aft alignment, or directional alignment along with the preselected path of the label supply roll 55. The combination of the tension springs 152, the slots 97 in the stabilizer bracket 96, and the print head alignment pins 95 provide for a self-aligning print head 94 in three directions. The print head chassis 144 is mounted within the upper housing 22 and lower housing 38 of the printing system 20, as shown in FIG. 2.

Magnetic Clutch

Figure 4A:
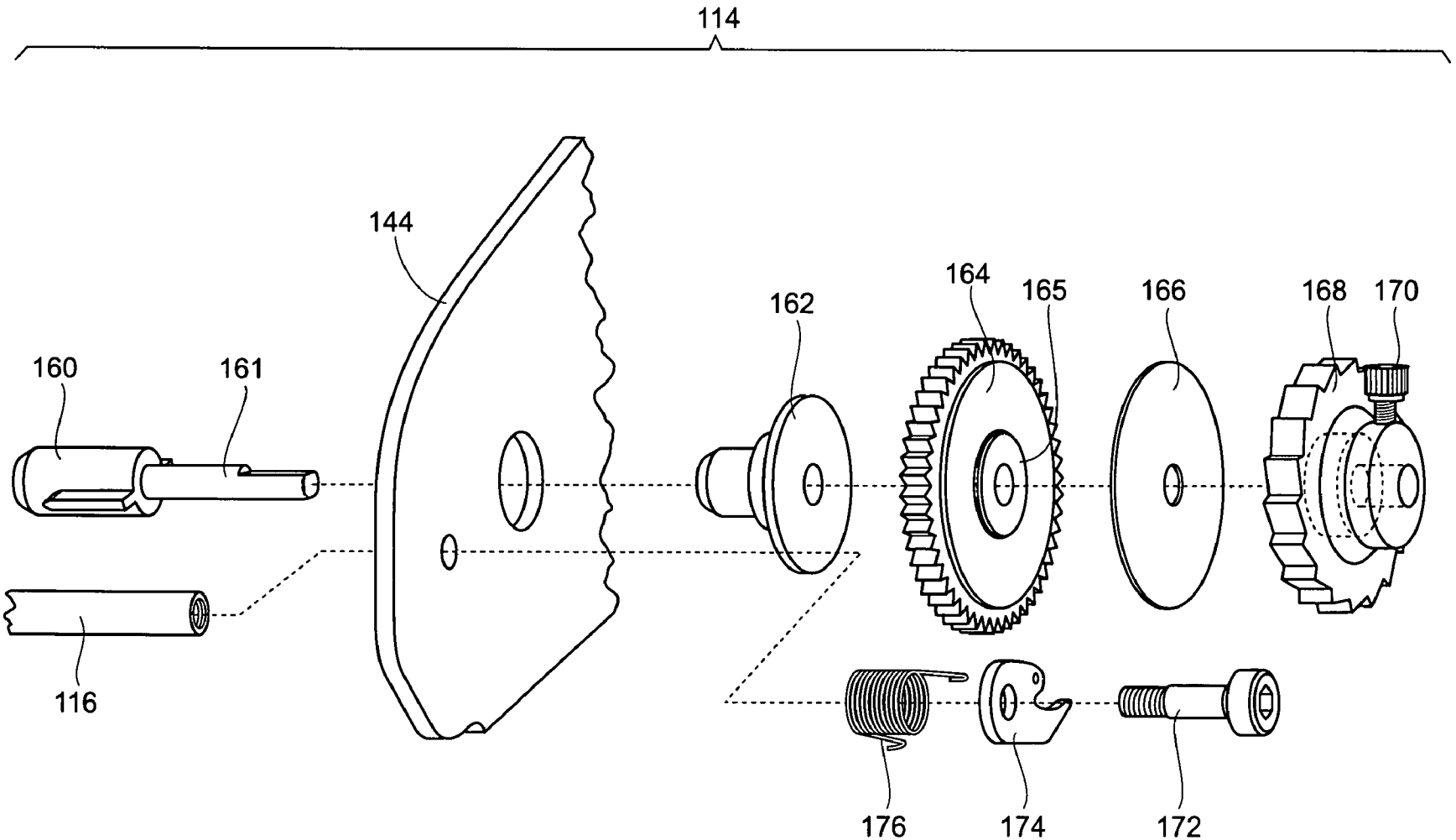
FIG. 4A is an exploded perspective view of the magnetic clutch assembly.

In order to eliminate the need to reverse the direction of the ink ribbon cartridge 30 (FIG. 1) when the direction of the label supply roll 55 (FIG. 7) is reversed, a magnetic clutch assembly 114, shown in FIG. 4A, provides for advancement of the thermal transfer ribbon 66 past the print head 94 while printing, yet does not allow the ribbon 66 to reverse its direction while the label supply roll 55 is reversed, as can be seen in FIG. 8. FIG. 4A shows a rare earth magnet 165 seated within a clutch gear 164. The clutch gear 164 is mounted on a spool drive spindle 161. The spool drive spindle 161 is inserted through a rear ribbon bushing 162, which is positioned within the print head chassis 144. A clutch disk 166 is positioned between the clutch gear 164 and a clutch ratchet 168. The clutch ratchet 168 is secured to the spool drive spindle 161 by a setscrew 170. A clutch pawl 174 is maintained in close relation to the clutch ratchet 168 by a pawl spring 176. The clutch pawl 174 and the pawl spring 176 are mounted on a shoulder screw 172, which is secured to a cage support tube 116.

Gear Mechanism

Figure 8B:
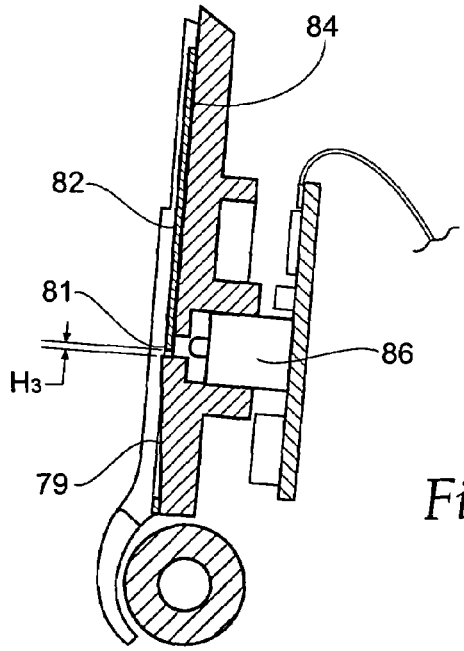
FIG. 8B is a cross section view of the data marking sensing components and the optical sensor taken along line 8B-8B of FIG. 4B.
Figure 9:
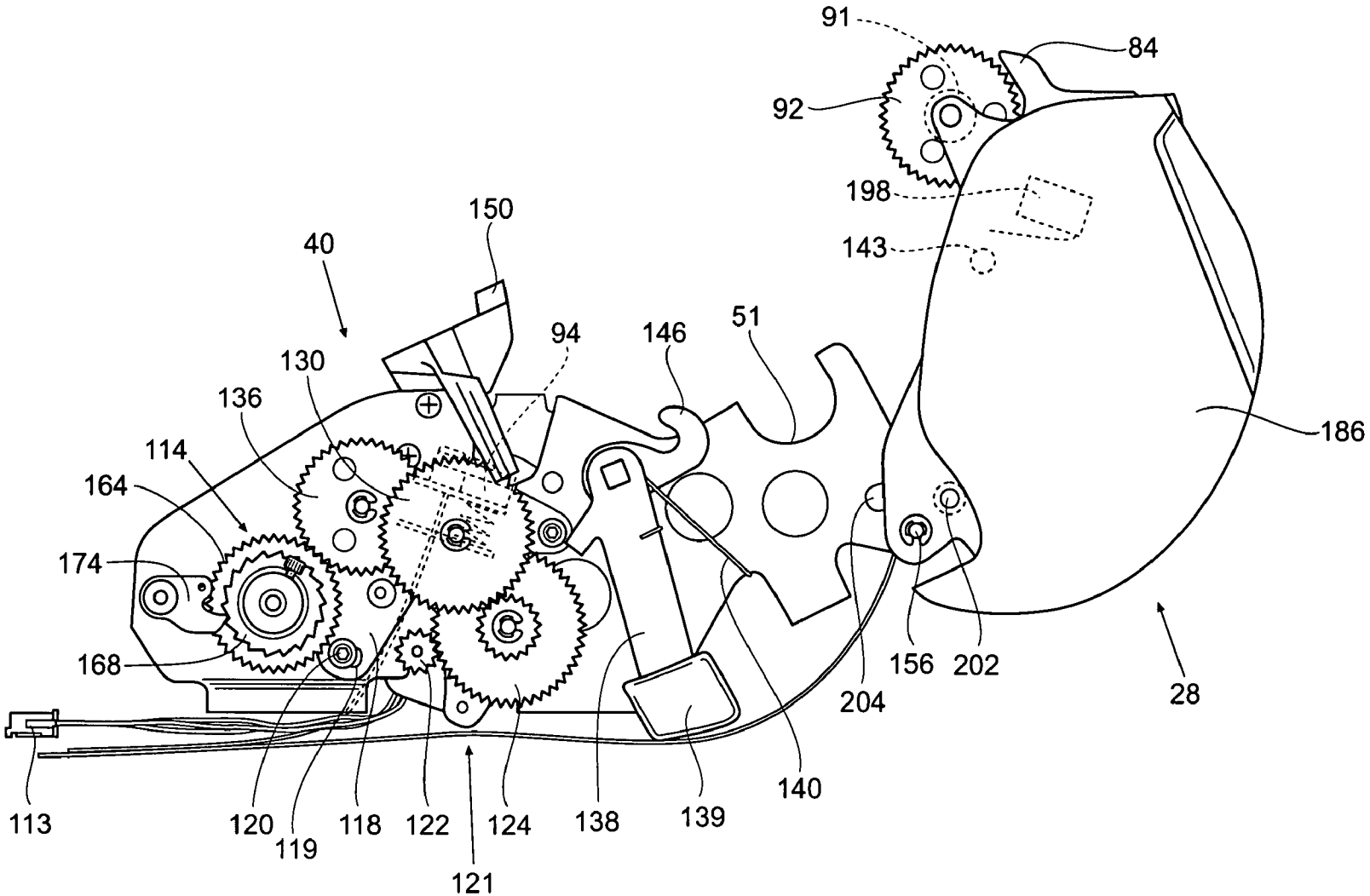
FIG. 9 is a side elevation view of the print assembly in an open position.
Figure 10:
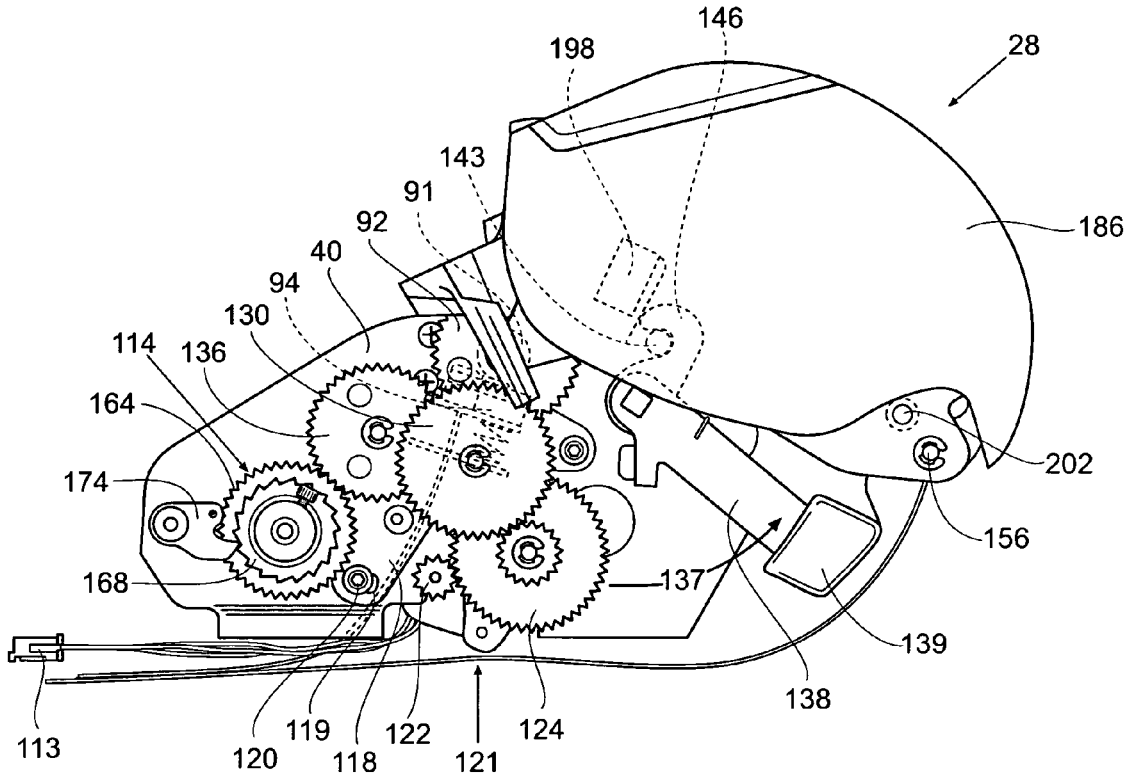
FIG. 10 is a side elevation view of the print assembly shown in FIG. 9 in a closed position.

Referring now to FIGS. 4, 9, and 10, a stepper motor 112 mounted in the print head chassis 144 engageably drives a bi-directional stepper motor gear mechanism 121. The stepper motor 112 includes a four-pin connector 113, adapted for connection to a mating receptacle (not shown) on the control circuit board 48. The remaining details of the exterior of the circuit board are shown in FIG. 12. The gear mechanism 121 is mounted on the print head chassis 144. The gear mechanism 121 drives the platen roller gear 92 and the magnetic clutch assembly 114. Slots 119 located in an adjustable gear plate 118 allow for adjustment of the alignment of gear 136 and gear 130, in relation to the magnetic clutch assembly 114 and gear 124, respectively. The magnetic clutch assembly 114 in turn rotatably drives the take-up spool 58 of the ink ribbon cartridge 30 to take up and supply the thermal transfer ribbon 66 past the print head 94, as seen in FIG. 8. Also with reference to FIG. 8, it may be seen that the label supply roll 55 and ribbon 66 are advanced past the print head 94. The platen roller 91 maintains the ribbon 66 and the label supply roll 55 in close cooperation with the print head 94.

More specifically, and as viewed on FIGS. 4A and 10, the stepper motor 112 (see FIG. 4) rotates in a first direction, thereby rotating drive gear 122 in a counter clockwise direction. Drive gear 122 in turn engages and rotates gear 124 in a clockwise direction. Gear 124 engages and rotates gear 130 in a counter clockwise direction, which engages both gear 136 and platen roller gear 92. The counter clockwise rotation of gear 130 causes both gear 136 and platen roller gear 92 to rotate in a clockwise rotation. Gear 136 engages the clutch gear 164 of the magnetic clutch assembly 114 (see FIG. 10). The magnetic clutch assembly 114 allows the clutch gear 164 to rotate in a counter clockwise direction. The magnetic force of the rare earth magnet 165 seated within the clutch gear 164 causes the clutch ratchet 168 to rotate in a counter clockwise direction, which also causes the drive cog 160 to rotate in a counter clockwise rotation. The drive cog 160 in turn rotatably drives the take-up spool 58 of the ink ribbon cartridge 30 to take up and supply the thermal transfer ribbon 66 past the print head 94 along the transfer ribbon path 67 (FIG. 8). Concurrently, the counter clockwise rotation of gear 130 causes clockwise rotation of platen roller gear 92, thereby causing the platen roller 91 to rotate in corresponding clockwise direction. The clockwise direction of the platen roller 91 urges the label supply roll 55 to advance past the print head 94 along the label supply roll path 89 (FIG. 8). As previously stated, the platen roller 91 maintains the ribbon 66 and the label supply roll 55 in close cooperation with the print head 94.

When the stepper motor 112 is rotating in an opposite direction, drive gear 122 rotates in a clockwise direction. Drive gear 122 in turn engages and rotates gear 124, which in turn engages and rotates gear 130 in a clockwise direction. Gear 130 again engages both gear 136 and platen roller gear 92, causing both gear 136 and platen roller gear 92 to rotate in a counter clockwise rotation. Gear 136 engages the clutch gear 164 of the magnetic clutch assembly 114. The magnetic clutch assembly 114 allows the clutch gear 164 to rotate in a clockwise direction. The magnetic force of the rare earth magnet 165 seated within the clutch gear 164 attempts to cause the clutch ratchet 168 to rotate in a corresponding clockwise direction, but the clutch pawl 174 engages the clutch ratchet 168 to restrict clockwise rotation of the clutch ratchet 168. The restriction of clutch ratchet 168 further restricts rotation of the drive cog 160. The take-up spool 58 of the ink ribbon cartridge 30 remains in a non-rotating state while the clutch gear 164 rotates in a clockwise direction. The thermal transfer ribbon 66 remains stationary at the print head 94 (FIG. 8). At the same time, the clockwise rotation of gear 130 causes platen roller gear 92 to rotate in a counter clockwise rotation. Platen roller gear 92 causes the platen roller 91 to rotate in a corresponding counter clockwise direction, which urges the label supply roll 55 to reverse past the print head 94 and recoil on the label spindle 34. This bi-directional label supply roll 55 feeding feature automatically feeds the label supply roll 55 forward for printing and severing of the label supply roll, and then allows for a reverse feed in order to be able to use all the labels 54 on the label supply roll 55.

Cover Assembly—Optical Sensor

Figure 5:
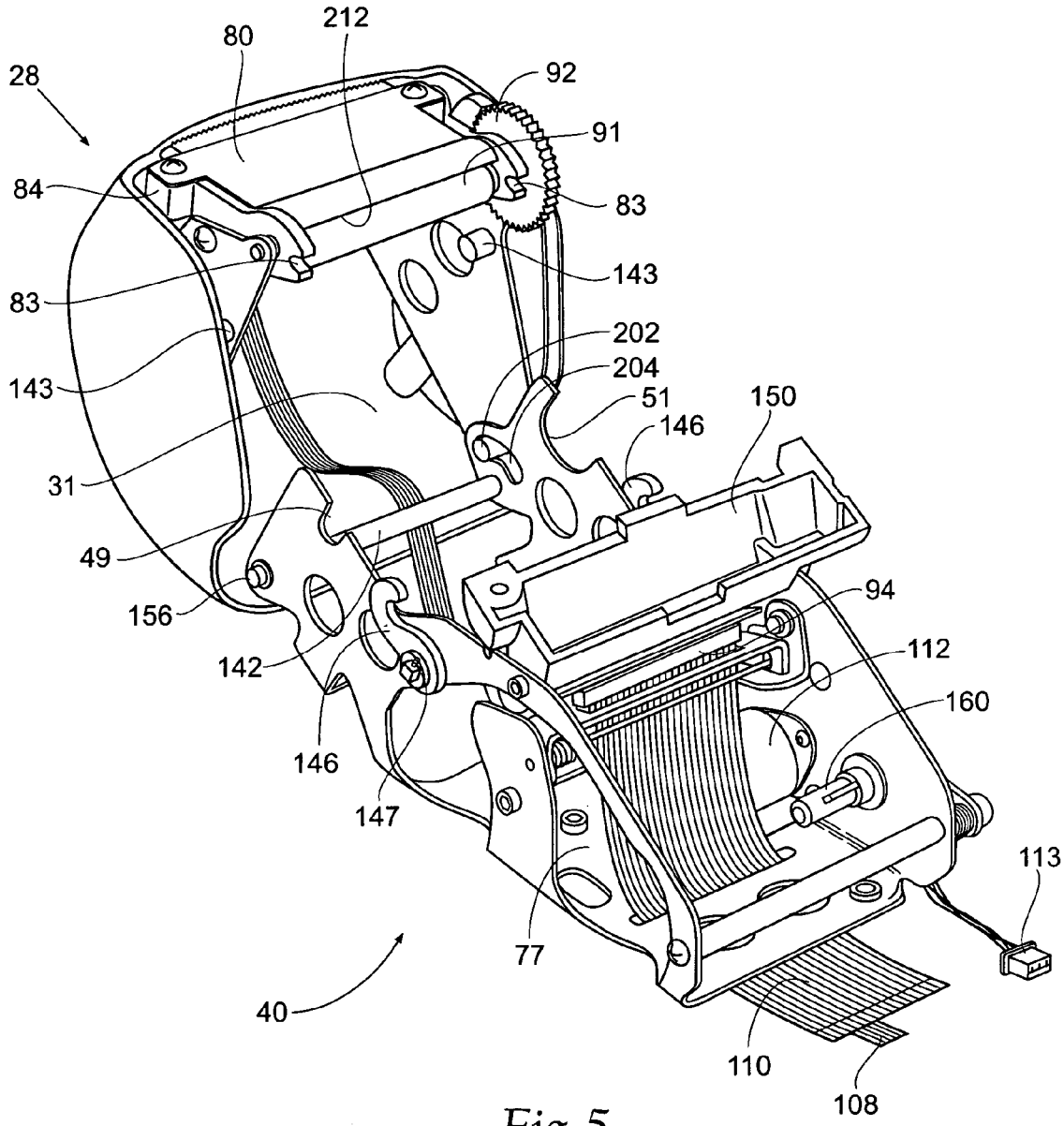
FIG. 5 is a perspective view of the cover and print assemblies of FIG. 2 in an open, label spindle-receiving position.

Now referring to FIG. 4, a cover assembly 28 may be seen to include a lid 186 and a cover chassis 90. The cover assembly 28 is pivotally attached to the print assembly 40, by way of a pivot axle 156 secured in place by c-clips 154. The pivot axle 156 is partially positioned within a pivot axle spacer 142. Additional spacers 188 and 190 may be positioned over the pivot axle 156 between the cover chassis 90 and the print head chassis 144. FIG. 5 shows a stop pin 202 mounted to the cover chassis 90. The print head chassis 144 preferably includes an oblong slot 204 formed therein, which receives the stop pin 202 and defines the extent to which the cover assembly 28 is allowed to pivot.

As best seen in FIG. 4, the cover assembly 28 preferably includes an optical sensor 86, secured to a label guide bracket 84 by way of screws 85 or other conventional means. The optical sensor 86 reads data marks, such as the barcode 194 shown in the Figures and located on the back side 192 of the carrier web 53 (see FIG. 14). As mentioned, barcode 194 or other data marks supply information to the printing system 20 such as identification of label specifications including type, size, print head heat, print speed, and label distance from one label to the next. The label guide bracket 84 is further secured to the cover chassis 90 with screws 88 or other conventional means.

Figure 4B:
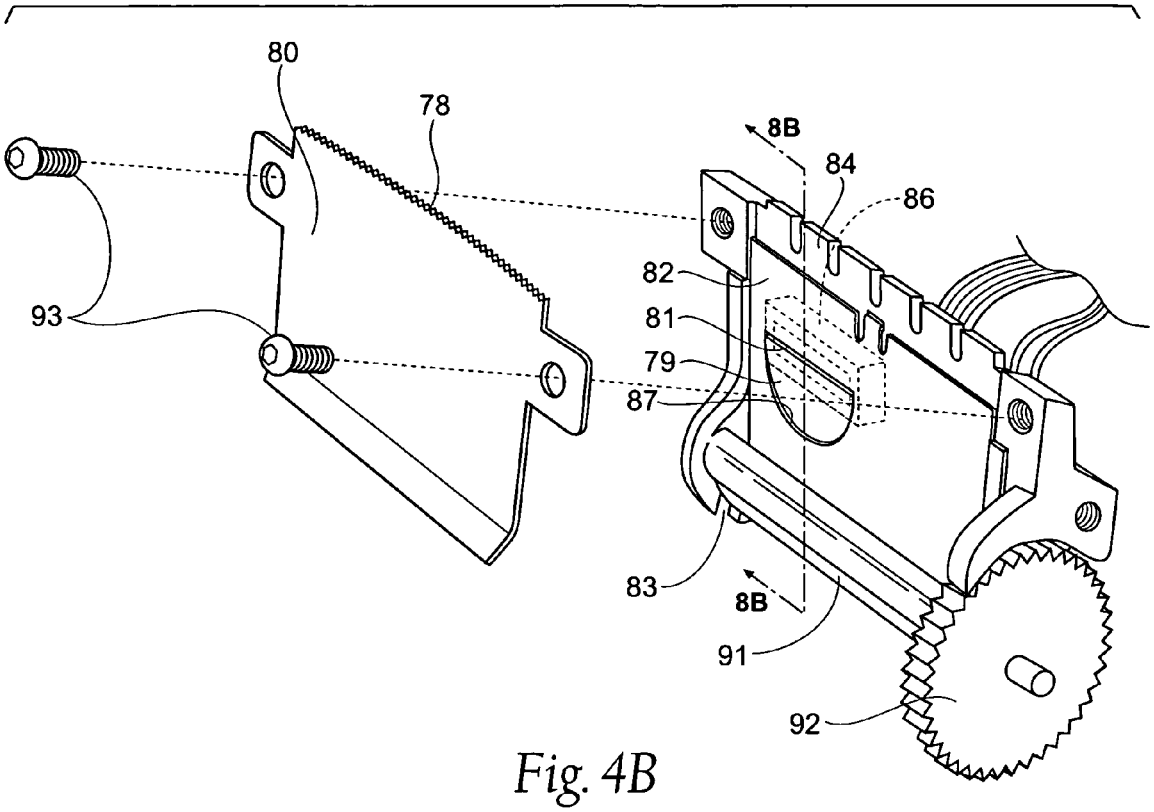
FIG. 4B is a partially exploded perspective view showing the data mark sensing components and label cutting edge, with the optical sensor shown in phantom.
Figure 4C:
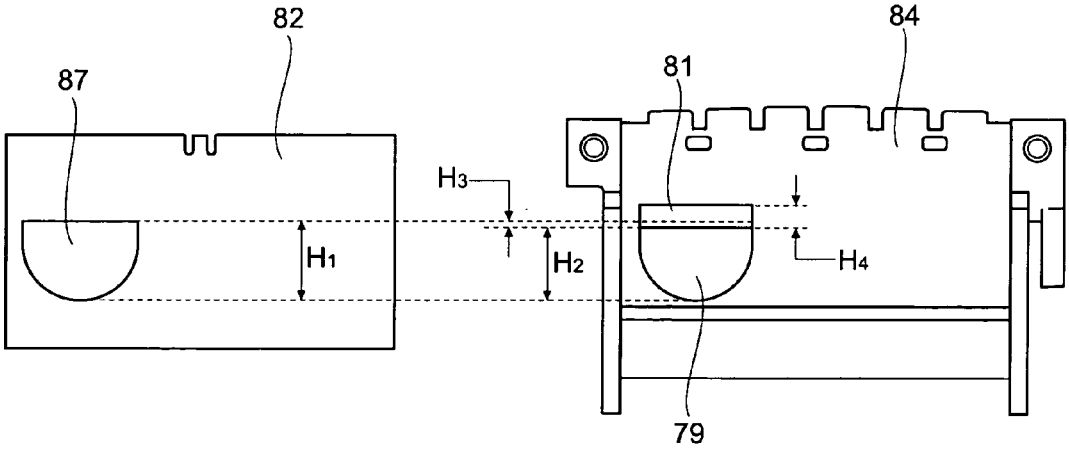
FIG. 4C is an exploded top plan view of the label sensor plate and label guide bracket depicted to thereby show the relationship between the height dimension of the aperture in the label sensor plate and the height dimension of the raised portion of the label guide bracket, and the resulting height dimension of the slot when the label sensor plate is positioned on top of the label guide bracket.

Referring to FIGS. 4B, 4C, and 8B, the label guide bracket 84 includes a slotted window 81 and a partial circular raised portion 79, which has an edge that terminates at a mating edge of the slotted window 81. The raised portion 79 mates up with a corresponding partial circular cutout 87 in a label sensor plate 82, positioned on top of the label guide bracket 84. The height of the slotted window 81 where the barcode 194 passes over the optical sensor 86 is critical for accurate barcode reading. To form a slot in just a metal plate with the specifications necessary to provide the accuracy required would be cost prohibitive. As illustrated in FIG. 4C, the present invention provides a novel solution. A predetermined height H3 is the critical space remaining when the label sensor plate 82 is positioned over the label guide bracket 84. Height H3 is the difference between predetermined height H1 of the partial circular cutout 87 and predetermined height H2 of the raised portion 79. The partial circular raised portion 79 is also novel in that it is slightly angled upwards from a rounded edge opposite the flat edge, which terminates at the edge of the slotted window 81. The raised portion 79 provides for a consistent elevation of the barcode 194 (FIG. 14) as it passes over the optical sensor 86 and provides for a single point of contact, as opposed to the full length of a slot, while the carrier web 53 is fed under the label guide plate 80. As shown in FIG. 8B, the resulting combination of the slotted window 81, the raised portion 79, and the label sensor plate 82, provide for accurate reading of the barcode 194 (FIG. 14) and smooth flow of the carrier web 53 over the optical sensor 86.

Cover Assembly—Platen Roller

Again referring to FIGS. 4, 7, and 8, a label guide plate 80 is mounted to the label guide bracket 84 with screws 93 or other conventional means and is seen to includes severing means 78 for the label supply roll 55, preferably shown as a serrated edge 78, adapted to perforate the label supply roll 55 and facilitate tear-off of the exposed portion of the label supply roll 55. The label guide plate 80 and the label guide bracket 84, in conjunction with the platen roller 91, define the path 89 of the label supply roll 55 (FIGS. 7 and 8), moving across the print head 94, and out through the cover assembly 28, past the serrated edge 78 for removal. The platen roller 91 is held in place by apertures 75 formed within the label guide bracket 84 (see FIG. 4). The platen roller gear 92 is disposed on an end of the platen roller 91 and is driven by the bi-directional stepper motor gear mechanism 121. The label guide bracket 84, and more specifically the label guide bracket yokes 83 coupled to the print head alignment pins 95, aids in positioning the platen roller 91 directly over the print head 94 when the cover assembly 28 is in the latched closed position seen in FIG. 10. When the cover assembly 28 is in an open position (FIG. 9), the platen roller 91 is retracted away from the print head 94 allowing for ease of installation of the label spindle 34 and ease of feeding the label supply roll 55 along the label supply roll path 89.

Cover Latching Mechanism and Operation

As best seen in FIG. 3, a cover latch knob 139 is positioned on a first end of a cover latch arm 138. As best seen in FIG. 4, a cover latch spindle 141 is secured to the cover latch arm 138. Cover latches 146 are preferably mounted on the cover latch spindle 141 on the outside edges of the print head chassis 144. A latch sleeve 148 may be positioned over the cover latch spindle 141 to aid in supporting the label supply roll 55 (FIG. 7). As seen specifically in FIG. 6, a latch shaft roll pin 147 secures the latch spindle 141 to the print head chassis 144. With reference to FIG. 9, a cover latch torsion spring 140 provides tension to urge the cover latch arm 138 to remain in a cover assembly open position. When the cover assembly 28 is in the open position shown in FIG. 9, an operator may position a reusable label spindle 34 within the print assembly 40 and feed the label supply roll 55 along the label supply roll path 89 shown in FIGS. 7 and 8. The operator may then close the pivotally attached cover assembly 28 over the label spindle 34 and urge the cover latch arm 138 in the direction indicated by arrow 137 on FIG. 10. The cover latches 146 engage the cover stop pins 143 to secure the cover assembly 28 in a closed position. Reversing this operation opens the cover assembly 28 to allow for removal of the label spindle 34. As best seen in FIGS. 9 and 10, a limit switch 198 secured to the cover chassis 90 provides feedback to an operator to indicate when the cover assembly 28 is properly closed.

Spindle and Installation of Label Supply Roll

Referring now to FIG. 14, the label spindle is indicated generally by the reference numeral 34. The label spindle 34 includes a label spool 50 and shaft 180, preferably having a plurality of grooves 184 formed therein. Grooves 184 are adapted to receive o-rings 52. The label spool shaft 180 receives the label supply roll 55. The label spool cap 56 includes an aperture 182 formed therein. An end of the label spool shaft 180 containing a protuberance 57 is inserted into the label spool cap aperture 182. The label spool cap 56 is then pushed toward the label spool until the label supply roll 55 is in close cooperation with both the label spool end 50 and the label spool cap end 56. The o-rings 52 allow the label spool cap 56 to be positioned along the label spool shaft 180 to accommodate different width label supply rolls 55.

Spindle and Spindle Installation into the Printing System

Figure 6:
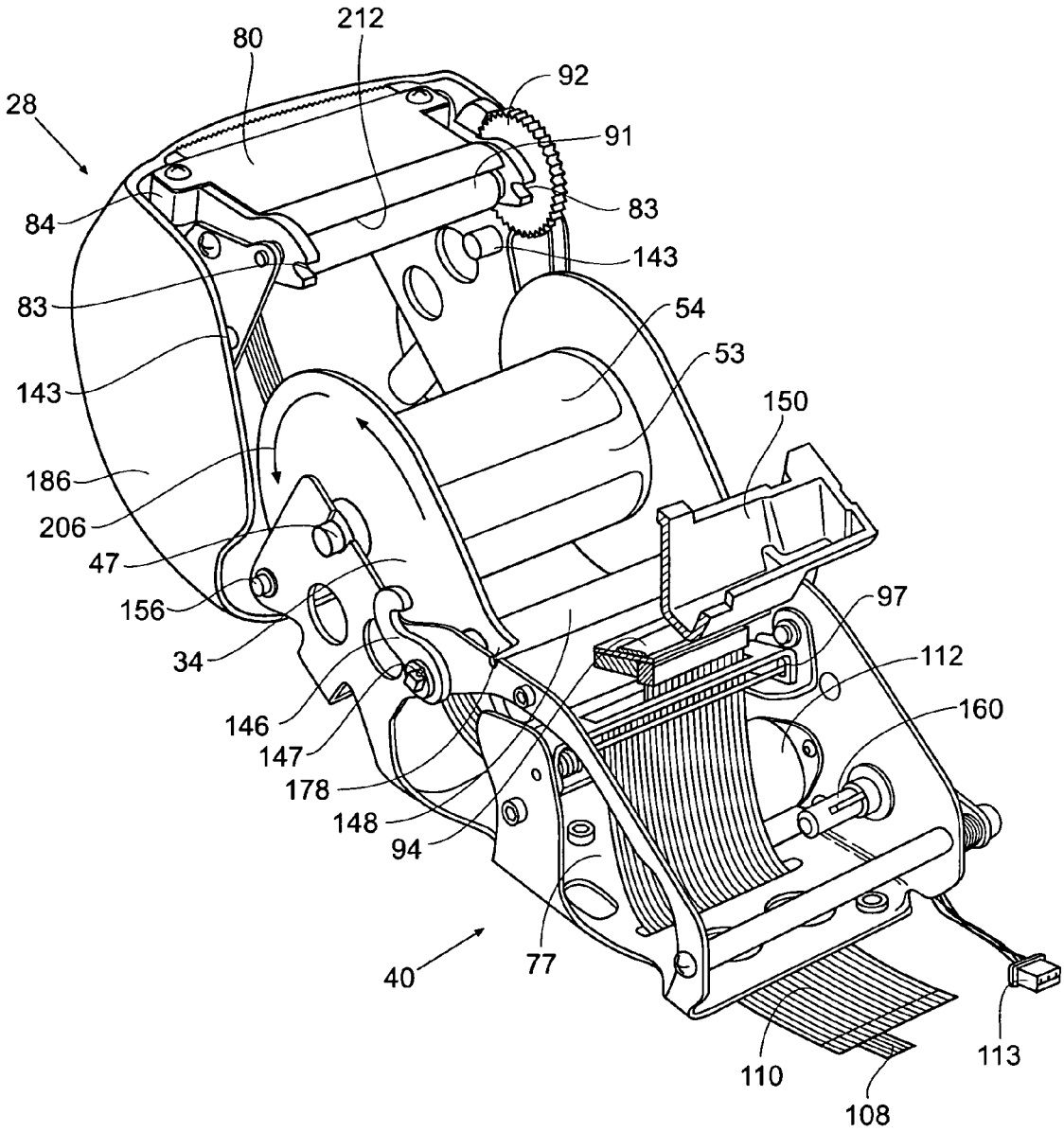
FIG. 6 is a perspective view of the cover and print assemblies of FIG. 5 in an open position, and showing the label spindle with rolled labels in place.

As best seen in FIG. 1A, with the cover assembly 28 in an open position, the label spindle 34 is removably placed within the two spindle guide slots 49 and 51 (FIGS. 3 and 6). Protuberance 47 on the label spool 50 is preferably configured such that it fits within spindle guide slot 49, and protuberance 57 on an end of the label spool shaft 180 will only fit within spindle guide slot 51 (see FIG. 14). This prevents improper placement of the reusable label spindle 34 within the printing system 20. Spindle arm yokes 178 mate with the center pivot axle spacer 142. The spindle arm yokes 178 and the label spindle protuberances 47 and 57 define a four-point label guide for the spindle 34, thereby providing a consistent position of the label supply roll 55 presented to the print head 94.

General Operation

The bi-directional stepper motor gear mechanism 121 of the printing system 20 is driven by circuitry to advance the label supply roll 55 and the thermal transfer ribbon 66. When a desired character is input by a user or other means, the electronics of the printing system 20 energizes pixels on the print head 94 as the label supply roll 55 and the ribbon 66 advance past the print head 94. The print head pixels are variously energized to imprint the character on the adhesive label 54. After printing, the label supply roll 55 is advanced to a tear-off position, at which time the operator manually tears-off the exposed portion of the label supply roll 55 containing the printed label 54.

With the structure of the printing system 20 and the novel cover assembly 28 and print assembly 40 described, a description of the operation of the printing system 20 will now be provided.

Installing the Ink Ribbon Cartridge

FIG. 10 depicts installation of the ink ribbon cartridge 30. A user first opens the cover assembly 28 of the printing system 20 by pulling down on the cover latch arm 138 in a direction opposite that of arrow 137. Referring to FIG. 2, the ribbon cartridge 30 is oriented so that the section of exposed ribbon 66 is directed toward the top 27 of the printing system 20. The ribbon cartridge 30 is slidably inserted into the ink ribbon cartridge cavity 77 for a snap fit. The ribbon cartridge door 74 is engaged by pushing the latch 76 in the direction of arrow 207.

Loading a Label Supply Roll on the Label Spindle

Now referring to FIG. 1A, removal of label spindle 34 from the printing system 20 and installation of a new label supply roll 55 may be seen. The reusable label spindle 34 is readily removed from inside the printing system 20 when labels 54 are exhausted, or when different labels 54 are desired.

FIG. 14 further illustrates changing of the type of the label 54. The user first pulls the label spool 50 and the label spool cap 56 apart. The label supply roll 55 having the desired label 54 type is received on the label spool shaft 180 with attention to the proper unwinding direction, indicated by the arrow 206 on each side of the label spindle 34. The user then replaces the label spool cap 56 on the label spool shaft 180 until it just touches the label supply roll 55.

Loading the Label Spindle in the Printing System

Again referring to FIG. 1A, the loaded label spindle 34 is placed into the spindle compartment 31 of the printing system 20. Again with reference to FIG. 14, ends 47 and 57 of the label spindle 34 are of different sizes to thereby prevent improper loading. Two hooks or label spindle yokes 178 are provided on the label spindle 34 that are adapted to engage latch sleeve 148 (see FIG. 6).

FIGS. 7 and 8 depict further loading of the label spindle 34. The carrier web 53 is inserted into the bottom 212 of the label guide bracket 84 and is positioned so that the carrier web 53 exits through the top 214 of the guide bracket 84. Once the carrier web 53 is moving smoothly under the label guide plate 80, the printing system 20 cover assembly 28 may be closed, preferably without pinching the carrier web 53 or the label supply roll 55 inside the printing system 20. When a new label supply roll 55 is loaded, the printing system 20 advances the supply roll 55 until it reads the barcode 194 on the back side 192 of the carrier web 53 (FIG. 14), at which point the printing system 20 recognizes the size and spacing of the label 54.

Navigating the Softkey Menu System

Now referring to FIGS. 15 and 16, a plurality of positions for "Softkeys" 210 located proximate the graphic display 26 may be seen. The function of the softkeys 210 changes depending on the MENU choice selected. The softkey function for each button 209 appears on the graphic display 26, at a position proximate to each button 209. This feature makes it easy for the user to navigate various menus without having to leave the image of a label 54 template. Pressing the MENU 220 key on the keyboard 24 returns the user to the default text edit options of LABEL, STATUS, SYSTEM, and PCLINK. From any point within the softkey 210 menu system, the DONE softkey 210 returns the user to the previous menu or screen while accepting any changes made in that current screen.

The Graphic Display

After loading a label supply roll 55 in the printing system 20 as described above, the graphic display 26 will depict an outline of the selected label 54, scaled to the size of the graphic display 26 for maximum viewing and ease of editing (FIGS. 15 and 16). This arrangement allows the user to view the placement and relative size of text, graphic images, or bar codes to be printed onto the label 54. As previously mentioned, the graphic display 26 is capable of showing multiple font sizes, for example, small, medium, and large. This feature gives the user options to thereby create clean, crisp, readable labels 54. The default text size will be the smallest displayable text font for the graphic display 26. If the selected label 54 is too large for the display, the user sees the top and side outline of the label 54 and must scroll down to the bottom of the label 54 using the direction pad 242 or the ENTER 222 key on the keyboard 24.

Applying Text to a Label

To apply text to a selected label 54, as shown in FIGS. 15 and 16, a user may press the LABEL softkey 210 on the default menu. A user then presses the INSERT softkey 210 to add a line of TEXT, BARCODE, or an IMAGE as desired. A user types in the TEXT and then presses the ENTER 222 key on the keyboard 24 when complete. To add an additional line, the user may press the INSERT softkey 210 again and select either TEXT, BARCODE, or IMAGE. A second line will appear below the last line on the label 54 image. Again, the user can enter text and then press the ENTER key on the keyboard 24 (FIG. 1) to complete the line. In a preferred embodiment, the default text size is usually the Medium or Normal text size. As the user types in the text, if the end of the line is reached, the text will automatically change to the Small text size allowing the user to continue.

Printing Labels

Still referring to FIGS. 15 and 16, after selecting the text to be printed on a label 54, the user may print a single label 54. To do so the user presses the PRINT 224 key on the keyboard 24. If a user wishes to preview the label print layout and relative size, the user may press the PREVIEW 226 button on the keyboard 24. The preview will be an estimation of the end print product and thereby allows the user to make modifications if desired without wasting any labels 54. To print multiple labels 54, press the FUNCTION 228 key and then the PRINT 224 key on the keyboard 24. The user will be prompted for the PRINT QUANTITY. The user scrolls to the number needed by using the softkey buttons 209. If a serial number has been created on the labels 54, when FUNCTION 228 and PRINT 224 are pressed, the user will also be prompted for the QTY PER SERIAL. As an example, if two of each serial number are required (one for each end of a wire or cable) the user can set the QTY PER SERIAL as two and the printing system 20 will print two of each serial number before advancing to the next one.

Using the Fill Feature

If the user wishes to create one line of text on a label 54 and then repeat that text for as many lines as the label will allow, the user moves the cursor to the line created and presses the FILL softkey 210. The printing system 20 will then copy this line to all other lines on the label. When the top line of a label is edited, all other lines will be automatically updated with it.

Adding a Serial Number to a Label

The printing system 20 of the present invention further allows printing of serial numbers on labels 54. The user types a predetermined starting serial number (alpha, numeric, or both) on any open line of a selected label 54. The cursor (not shown) is positioned on the line of text to be incremented, and the user presses the SERIAL 230 key on the keyboard 24. This automatically flags the line as a serial number and the printing system 20 will start incrementing in a logical sequence, starting with the last digit in the line. As an example, if the line of text is 1000, then as the printing system 20 prints, that line will print as a serial number on each label: 1000, 1001, 1002, etc. If the user types in 10Y8 as the starting serial number (a four digit alphanumeric character), the printing system 20 will sequentially print the following: 10Y8, 10Y9, 10Z0, 10Z1, etc. An "S" will appear next to the EDIT 232 softkey 210 for any line that is set for serialization. To view the "S", a user moves the cursor to the line that is selected for serialization.

If the user presses the PRINT 224 key on the keyboard 24, when the label 54 has a serialized field on it, the printing system 20 will ask how many of each serial number the user wishes to print before printing the next serial number in the sequence. For instance, if the user requires two of each (one for each end of the wire or cable) the user depresses the 2 254 key on the keyboard 24 when prompted.

Vertical or Continuous Printing

The printing system 20 is further adapted to print on continuous (not separated by a gap) label material for terminal blocks, the front of patch panels, or any other application. In a preferred embodiment, the printing system 20 allows the user flexibility to change the print spacing by predetermined, for example 0.025" (0.635 mm) increments from 0.30" on up to 1" or more between printed legends.

First, the software in the printing system 20 detects the width of the continuous stock (as there are no gaps to detect) and sets the proper heat code for the print head 94. When the printing system 20 has read the barcode 194 successfully, the user is asked to setup the STYLE and SPACE. The user presses the STYLE softkey 210 to cycle through the following illustrative printing options: SQUARE, WIDE, and VERY WIDE. Selecting VERY WIDE will give the user a printable length that is 185% of the continuous label width. As an example, if a continuous label is 0.333" (8.45 mm) wide, selecting VERY WIDE will produce a label that is 0.616" long (0.333×1.85=0.616"). As a second example, if the label width was 1.0" wide, then your label size would be 1.85"×1.0" in dimension (1.0×1.85=1.85"). If the user selects WIDE, the label length is 150% of the width of the continuous label and if the user selects SQUARE, the label length is 100% of the width. By using the up and down arrow 244 keys on the keyboard 24, the user may adjust the total distance between printed marks on the label 54. The dimensions for inches or centimeters will change at the same time in 0.025" (0.635 mm) increments.

Next, the user is asked to select the SPACE between printed labels. If the spacing between ports on a patch panel is 0.625" (15.87 mm), then the user simply increments with the +/−25 softkeys 210. The label 54 will be seen on the graphic display 26 in a horizontal format for easy editing, but will print vertically when printed.

Finally, the user may print the label 54 by pressing the FUNC 228 key and then the PRINT 224 key on the keyboard 24. The user selects how many labels are required and presses the PRINT 224 key on the keyboard 24. The printing system 20 will then print the information vertically as it exits the printing system 20. To get the last printed label 54 in the strip, the user presses the FEED 236 button on the keyboard 24 until the last printed text is above the tear off point 78.

Primary Keys

As best seen in FIG. 1, the keyboard 24 preferably comprises a complete arrangement of keys for the operation of the novel functionality of the printing system 20. The keyboard 24 includes, but is not limited to the following primary keys:

FUNC 228 allows special characters or operators (shown in red on most keys) to be accessed. The user presses the FUNC 228 key first and then the key with the character or operation to use.

ESC 238 returns the user to the previous screen from any screen. By pressing the FUNC 228 and then ESC 238 keys, the current print job in progress will be aborted.

CLEAR 240 will delete an entire line of text. By pressing FUNC 228 and CLEAR 240, an entire line of text will be deleted.

DIRECTION PAD 234 moves the cursor (not shown) through text without changing the text, and through options without selecting any options. The left and right arrow 234 keys move the cursor left and right one option/character at a time. The up and down 244 keys move the cursor up and down through lines of text, one line at a time or one option at a time.

SERIAL 230 automatically causes the last character in a line of text to start incrementing as each label is printed.

FEED 236 once advances one label at a time. Press and hold FEED 236 feeds continuously.

MENU 220 takes the user to the main menu of the printing system 20.

POWER 246 turns the printing system 20 on. Pressing and holding the POWER 246 key for two seconds will turn the printing system 20 off.

ENTER 222, while in an edit mode, moves to the next line on a label 54 when the user is entering text to a label. While in a function mode, ENTER 222 is used to select menu options, file names, and attribute changes.

PREVIEW 226 allows the user to view an entire label 54, at a reduced scale, as it will print. As previously discussed, the PREVIEW 226 key is used to view the general layout and placement of text, graphic images, and barcodes prior to printing.

PRINT 224 prints the current label job. FUNC 228 and PRINT 224 allow the user to select how many of each label 54 and the total number of labels 54 to be printed.

CAPS 248 allows the user to toggle between upper and lower case letters.

DEL 250 removes one character to the left of the cursor.

UNDO 252 allows the user to undo the last change made to the label 54. This also allows the user to retrieve lost lines or characters due to font size changes.

SPACE will insert a blank space in any line of text.

Moving a Line on a Label

Referring now to FIGS. 15 and 16, the user selects a line of text, barcode, or image on the graphic display 26 to be moved and presses the FUNC 228 key and then the "X" 256 key to CUT that line from the label 54. The line may now be repositioned. The user presses the FUNC 228 key and then the "V" 258 key to paste the line above any currently selected line on the label 54. Or, the user may press the FUNC 228 key and then the "A" 260 key to paste the line at the bottom of the label 54.

Adjusting Print Quality

The printing system 20 is adapted to provide for the user the ability to adjust parameters that may affect print quality. In a preferred embodiment, the user can adjust the temperature of the print head 94 (FIG. 4) and the speed at which the labels travel past the print head 94.

To adjust the print quality, the user presses the MENU 220 key on the keyboard 24 followed by the SYSTEM softkey 210. The user then presses the ">" softkey 210 to scroll the softkey menu 210 to the right. The user presses the PARAM softkey 210. Finally, pressing the BURN softkey 210 will adjust the heat used to transfer ink from the ribbon 66 (FIG. 8) to the label 54. Also, pressing the MOTOR softkey 210 will adjust the speed at which the label 54 travels past the print head 94 (FIG. 7).

It is important to note that increasing burn temperature or slowing the speed of the label 54 down does not always solve print density. If the printing process is running too hot, the print will start to look washed out and the outer edges of each character will look darker than the inside of each character. In this case, using less temperature on the print head 94 will increase the print quality.

The length of the printed label can be defined using a "Set" feature. Continuous length labels or shrink tubing can be loaded vertically into the printing system 20. The Set feature allows the length of label to be pre-set to almost any length. The printed text can be oriented vertical or horizontal when using this feature. This continuous vertical print option is extremely useful for patch panels, wall plates, terminal blocks, and wire markers.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention.

We claim:

1. A handheld label printer comprising:

a housing, said housing including a print assembly, said print assembly comprising:

a supporting print head chassis;

a housing cover chassis in pivotal relationship with said print head chassis, said print head chassis supporting an ink supply cartridge, a print head, and label supply means, said label supply means including a label media having a printable surface area and an area containing optically readable information, said housing chassis supporting an optical sensor for reading and communicating said optically readable information to said print head;

means for advancing said label supply means along a preselected path within said print assembly;

means for visually displaying said communicated information.

2. The label printer according to claim 1 wherein said label supply advancing means provides alternative movement in a forward and in a reverse direction along said preselected path, said label printer further comprising means for severing said label supply means transversely of said preselected path.

3. The label printer according to claim 2 wherein said label supply advance means comprises a magnetic clutch assembly.

4. The label printer according to claim 1 wherein said label supply advancing means includes a supporting plate, said supporting plate including a window located on said preselected path, said window being of a preselected dimension, said window permitting accurate readability of said optically readable information.

5. The label printer according to claim 4 wherein said supporting plate includes a substantially planar surface, said planar surface including a raised portion having an edge terminating at a mating edge of said window.

6. The label printer according to claim 1 further comprising means for self-aligning said print head in three directions respective to said preselected path.

7. The label printer according to claim 1 further comprises means for inputting information to be printed on said printable surface area of said label media.

8. The label printer according to claim 7 wherein said visual display means comprises a screen, said screen displaying a virtual image of said information to be printed on said printable surface area.

9. The label printer according to claim 7 wherein said input means comprises a keyboard.

10. The label printer according to claim 7 wherein said input means being connected to a control circuit.

11. The label printer according to claim 10 wherein said control circuit being in communication with means for transferring data to said control circuit from external sources.

12. The label printer according to claim 10 further comprising power means for said label printer.

13. The label printer according to claim 12 wherein said power means comprises a battery having a defined lifespan, said control circuit minimizing degradation of printed labels through said lifespan of said battery.

14. A handheld label printer comprising:

a housing including a print assembly, said print assembly comprising:

a supporting print head chassis;

a housing cover chassis in pivotal relationship with said print head chassis, said print head chassis supporting an ink supply cartridge, a print head, and label supply means, said label supply means including a label media having a printable surface area;

means for advancing said label supply means along a preselected path within said print assembly; and means for self-aligning said print head in three planes respective to said preselected path.

15. The label printer according to claim 14 wherein said self-aligning means being capable of aligning said print head transversely respective of said preselected path, elevationally respective of said preselected path, and directionally along said preselected path.

* * * * *